US007817939B2

(12) United States Patent
Takahashi et al.

(10) Patent No.: US 7,817,939 B2
(45) Date of Patent: Oct. 19, 2010

(54) IMAGE HEATING DEVICE

(75) Inventors: Masahiro Takahashi, Kashiwa (JP); Masahiko Yokota, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 302 days.

(21) Appl. No.: 12/140,957

(22) Filed: Jun. 17, 2008

(65) Prior Publication Data

US 2008/0317524 A1 Dec. 25, 2008

(30) Foreign Application Priority Data

Jun. 20, 2007 (JP) ..... 2007-162489

(51) Int. Cl.
*G03G 15/20* (2006.01)

(52) U.S. Cl. ..... 399/124; 399/329

(58) Field of Classification Search ..... 399/124, 399/329

See application file for complete search history.

(56) References Cited

U.S. PATENT DOCUMENTS 5,669,054 A * 9/1997 Uchida et al. ..... 399/313

FOREIGN PATENT DOCUMENTS

JP 3-233589 A 10/1991
JP 11-231701 A 8/1999

* cited by examiner

*Primary Examiner*—David M Gray
*Assistant Examiner*—G. M. Hyder
(74) *Attorney, Agent, or Firm*—Canon U.S.A., Inc. I.P. Division

(57) ABSTRACT

When removing a sheet that is undesirably attached to a pressure belt as a result of a jam, if the sheet is pulled in the width direction of the pressure belt, the pressure belt may undesirably move in the width direction. This will make it difficult to perform a subsequent jam recovery operation properly.

In order to solve this problem, a belt gripping roller can be brought into pressure contact with the pressure belt in the event of a jam, so as to prevent the pressure belt from being moved accidentally in the width direction while the jam is being cleared.

9 Claims, 21 Drawing Sheets

IMAGE HEATING DEVICE

BACKGROUND OF THE INVENTION

1. Field of the Invention

The present invention relates to image heating devices for heating toner images formed on recording materials.

Known examples of image heating devices are a fixing device for fixing an unfixed toner image onto a recording material and a gloss enhancing device that heats a toner image fixed on a recording material to enhance the glossiness of the image.

Image heating devices can be used in image forming apparatuses that form toner images on recording materials by electrophotography. An example of such an image forming apparatus is a multifunction apparatus equipped with multiple functions, such as a copier function, a printer function, and a facsimile function.

2. Description of the Related Art

In a known image forming apparatus employing electrophotography, an unfixed toner image is first formed on a recording material, and subsequently, a fixing device equipped in the apparatus is used to heat and apply pressure on this unfixed image so as to fix the image on the recording material.

As an example of a fixing device, Japanese Patent Laid-Open No. 11-231701 discloses a belt fixing device which is advantageous in that the width of a fixing nip portion (i.e. the measure thereof in the conveying direction of recording material) can be increased for speeding up the image forming process.

A belt fixing device is configured such that, when the fixing process is complete, the device switches to a standby mode by moving a pressure belt away from a fixing roller.

This belt fixing device is known to control the pressure belt to keep the pressure belt from deviating from a preset range in its width direction. Specifically, this is achieved by tilting a steering roller that supports the pressure belt so that the pressure belt is slid sideways within the preset range.

As another mechanism, a position restricting mechanism is known, which is equipped with position-restricting ribs located adjacent to the edges of the inner surface of the pressure belt. These position-restricting ribs can be brought into abutment with a flange of the roller that supports the pressure belt, so that the pressure belt can be prevented from deviating from a preset range.

However, these known examples have the following problems.

Specifically, in a case where a recording material is undesirably attached to the pressure belt as a result of a jam occurring in the fixing device, it is possible that the pressure belt becomes deviated from its preset range while the pressure belt is being pulled out in the course of clearing the jam.

Although such deviation can be prevented if the user pulls the recording material off the pressure belt in the moving direction of the pressure belt, there is a high possibility that the deviation may occur if the user tries to remove the recording material slantwise or sideways from the pressure belt.

Such a phenomenon in which the pressure belt deviates from its preset range is not avoidable with the above-mentioned position restricting mechanism.

SUMMARY OF THE INVENTION

According to an aspect of the present invention, an image heating device is provided which includes an endless belt that allows a toner image on a recording material to be heated at a nip portion; a rotary member configured to form the nip portion together with the endless belt; a contact/separation unit configured to perform a contact or separation operation to bring the endless belt and the rotary member into or out of contact with each other; and a restricting unit configured to relatively move to a position where the restricting unit comes into pressure contact with an outer surface of the endless belt so as to restrict a movement of the endless belt in a width direction thereof when the recording material is being removed from the endless belt in a separated state from the rotary member.

According to another aspect of the present invention, an image heating device is provided which includes an endless belt that allows a toner image on a recording material to be heated at a nip portion; a rotary member configured to form the nip portion together with the endless belt; a supporting member that rotatably supports the endless belt; a control unit configured to perform control so as to correct misalignment of the endless belt in a width direction thereof in the course of rotation of the endless belt, the control being performed by displacing at least one longitudinal end of the supporting member; and a restricting unit disposed outside the endless belt in the width direction. In a state where the endless belt is stopped from rotating, the restricting unit is configured to relatively move to a contact position where the restricting unit is contactable with an edge of the endless belt in the width direction so as to restrict a movement of the endless belt in the width direction when the recording material is being removed from the endless belt.

Further features of the present invention will become apparent from the following description of exemplary embodiments with reference to the attached drawings.

DESCRIPTION OF THE EMBODIMENTS

Exemplary embodiments of an image heating device according to the present invention are described below in detail with reference to the drawings.

First Embodiment

Figure 1:
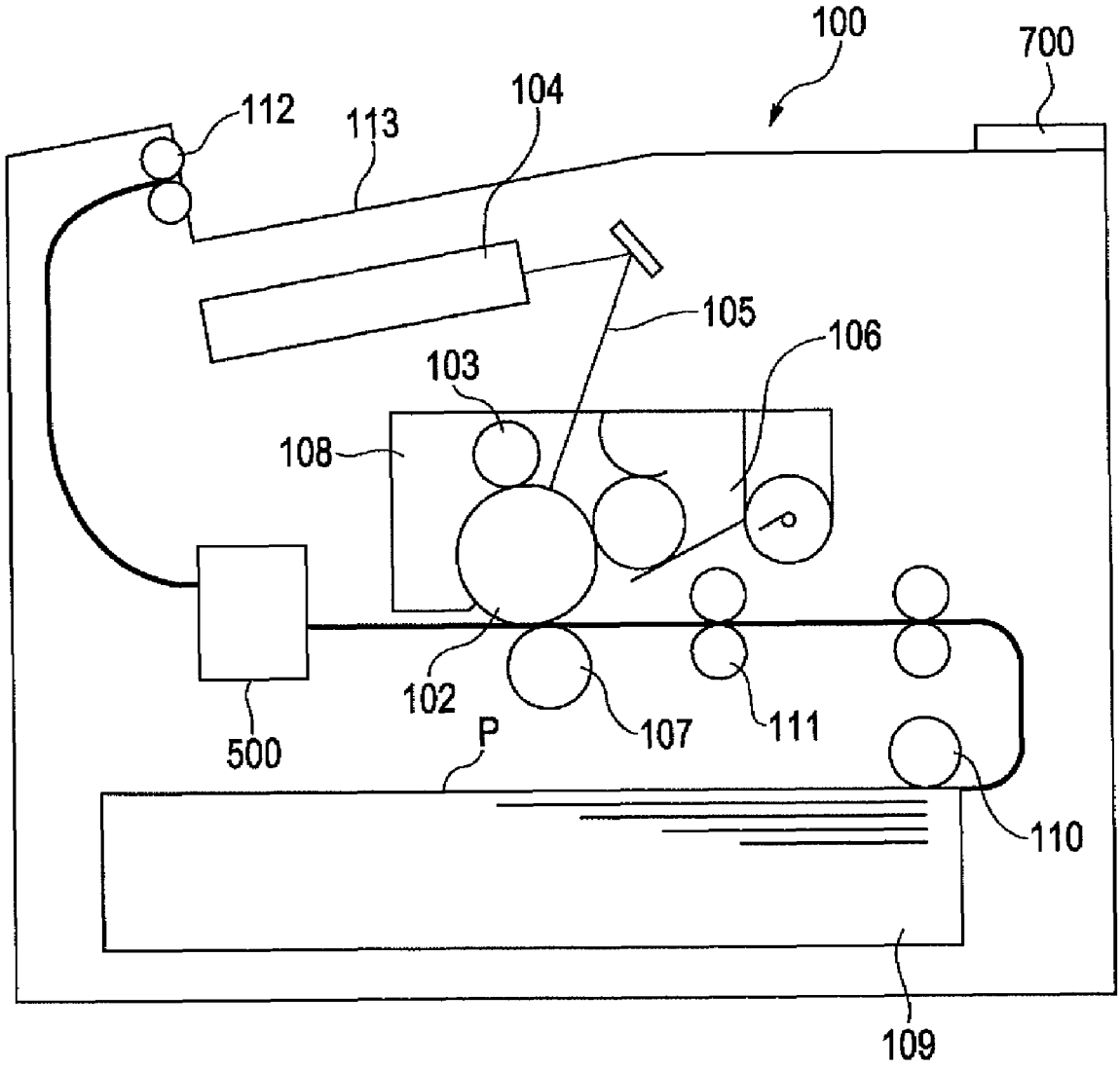
FIG. 1 is a schematic cross-sectional view showing the overall configuration of an image forming apparatus according to a first embodiment of the present invention.

The overall configuration of an image forming apparatus is described first with reference to FIG. 1. Thereafter, a fixing device included in the image forming apparatus is described in detail with reference to FIGS. 2 and 3.

Image Forming Apparatus

FIG. 1 is a schematic cross-sectional view of an image forming apparatus 100. Image forming apparatus 100 is a printer that employs electrophotography.

The image forming apparatus 100 includes an image forming device (described below) configured to form a toner image on a sheet P serving as a recording material, and a fixing device serving as an image heating device for heating and applying pressure on the toner image formed on the sheet P to fix the image on the sheet P.

The image forming device includes a photosensitive drum 102, a charger 103, an exposure unit 104, a developer 106, a transfer roller 107, and a cleaning unit 108. These components included in the image forming device are described below.

Specifically, in the image forming apparatus 100, the photosensitive drum 102 serves as an image bearing member that is rotatable clockwise, and the charger 103 is disposed on the periphery of the photosensitive drum 102. The charger 103 can electrically charge the surface of the photosensitive drum 102 evenly. In this embodiment, the charger 103 is configured to electrically charge the photosensitive drum 102 to negative polarity.

The exposure unit 104 emits a laser beam 105 toward the surface of the negatively charged photosensitive drum 102 in response to an image information signal received from an external host computer. As a result, an electrostatic latent image is formed on the photosensitive drum 102.

The developer 106 develops the electrostatic latent image formed on the photosensitive drum 102 with toner so as to form a toner image on the photosensitive drum 102.

A sheet or sheets P is/are stored in a feeder cassette 109 located at the bottom of the apparatus 100. Each sheet P is fed to a pair of registration rollers 111 by a feeding roller 110. The pair of registration rollers 111 then conveys the sheet P to the transfer roller 107 in synchronization with formation of the toner image on the photosensitive drum 102. Subsequently, the transfer roller 107 electrostatically transfers the toner image formed on the photosensitive drum 102 onto the sheet P.

The cleaning unit 108 then removes the toner remaining on the photosensitive drum 102 to prepare for the subsequent image forming process.

The sheet P having the toner image formed thereon is conveyed to a fixing device 500. The fixing device 500 heats and applies pressure to the toner image on the sheet P so as to fix the image onto the sheet P. Subsequently, the sheet P having the toner image fixed thereon is ejected by a pair of ejecting rollers 112 onto an ejection tray 113 located at the top of the apparatus 100.

Fixing Device

The fixing device 500 serving as an image heating device is described in detail below with reference to FIGS. 2 and 3.

The fixing device 500 includes a heating unit 1 contactable with an unfixed toner image formed on a sheet P, and a pressure unit 2 contactable with a surface of the sheet P opposite to the surface having the unfixed toner image.

A heating belt 13 is formed of a polyimide (PI) resin base layer coated with 300-μm-thick silicon rubber, the PI resin base layer being 75 μm in thickness, 380 mm in width, and 150 mm in perimeter. The heating belt 13 does not necessarily have to be formed of the aforementioned material, and other alternative materials can be used that have heat resisting properties. Moreover, the thickness and the perimeter of the heating belt 13 are not limited to the aforementioned values and may be adjusted to appropriate values.

The heating unit 1 includes the heating belt 13 which is an endless belt (heating rotary member), a heating roller 11, and a tension roller (supporting member) 14. The heating roller 11 and tension roller 14 support the heating belt 13.

The tension roller 14 supporting the heating belt 13 applies tension to the heating belt 13 so as to set the tension of the heating belt 13 at a predetermined value (100 N in this embodiment). The tension roller 14 is a hollow roller composed of stainless steel and having an outside diameter of about 20 mm and an inside diameter of about 18 mm. The tension roller 14 also functions as a steering roller for sliding the heating belt 13 sideways in the belt-width direction while the heating belt 13 is moving. In this embodiment, the term "belt-width direction" or simply "width direction" refers to a direction perpendicular to the moving direction of a belt and extending parallel to the rotational axes of the rollers supporting the belt.

This steering mechanism includes a position sensor 14A that detects the position of the heating belt 13 in the width direction, and a displacement mechanism that displaces one longitudinal (axial) end of the tension roller 14 in the vertical direction. In order to prevent the heating belt 13 from deviating from a preset range while the heating belt 13 is moving (during a fixing process), a controller (CPU) 600 actuates the displacement mechanism based on the detection result of the position sensor 14A so as to displace the tension roller 14 in the vertical direction. This prevents the edges of the heating belt 13 from deteriorating as a result of the heating belt 13 being misaligned in the width direction.

This displacement mechanism for the tension roller 14 may alternatively have the following configuration.

Specifically, the displacement mechanism may be configured to displace the opposite longitudinal ends of the tension roller 14 in opposite vertical directions. In other words, the displacement mechanism may be configured to displace one longitudinal end of the tension roller 14 upward while displacing the other longitudinal end downward. With this configuration, it becomes possible to reduce the displacement amount of the tension roller 14 necessary for preventing the heating belt 13 from deviating from the preset range while the heating belt 13 is moving.

The heating roller 11 is a hollow cylindrical roller composed of stainless steel and having an outside diameter of 20 mm.

The heating roller 11 has disposed therein a halogen heater 12 as a heating source. The heating roller 11 also has a temperature sensor 12A that is disposed in contact with the outer surface of the heating belt 13 such that the temperature sensor 12A can detect the temperature of the heating belt 13. Based on the detection result of the temperature sensor 12A, the controller 600 controls the electricity supplied to the halogen heater 12. This enables the heating belt 13 to be maintained at a set temperature, e.g. a target temperature (which is 180° C. in this embodiment). Heat can be evenly distributed to the toner T on the sheet P, thereby allowing for a proper fixing process (image heating process).

The heating roller 11 also functions as a driving roller for driving the heating belt 13.

A metallic pressure pad 19 is disposed at an entrance side of a nip region formed between the heating roller 11 and a pressure roller 15 to be described hereinafter. The pressure pad 19 is positioned in this manner to ensure a sufficient length for a fixing nip portion (in the sheet conveying direction). In other words, in this embodiment, the fixing nip portion extends over a sufficiently long distance from a nip region formed between the pressure pad 19 and a pressure pad 18 to be described hereinafter to the nip region formed between the heating roller 11 and the pressure roller 15.

The pressure unit 2 is described next.

The pressure unit 2 is constituted by a pressure belt 16 which is an endless belt (pressure rotary member), and by the pressure roller 15 and a tension roller (supporting member) 17 that support the pressure belt 16. The fixing nip portion is formed between the pressure belt 16 and the heating belt 13.

The pressure belt 16 is formed of a polyimide (PI) resin base layer coated with 300-μm-thick silicon rubber, the PI resin base layer being 75 μm in thickness, 380 mm in width, and 150 mm in perimeter. The pressure belt 16 does not necessarily have to be formed of the aforementioned material, and other alternative materials can be used that have heat resisting properties. Moreover, the thickness and the perimeter of the pressure belt 16 are not limited to the aforementioned values, and may be adjusted to appropriate values.

In addition to having the function of pressing the pressure belt 16 against the heating belt 13 with a predetermined pressure, the pressure roller 15 also functions as a driving roller for driving the pressure belt 16. The pressure roller 15 is a hollow cylindrical roller composed of stainless steel and having an outside diameter of 20 mm.

The tension roller 17 applies tension to the pressure belt 16 so as to set the tension of the pressure belt 16 at a predetermined value (100 N in this embodiment). The tension roller 17 is a hollow roller composed of stainless steel and having an outside diameter of about 20 mm and an inside diameter of about 18 mm.

The tension roller 17 also functions as a steering roller for sliding the pressure belt 16 sideways in the belt-width direction while the pressure belt 16 is moving.

This steering mechanism includes a position sensor 17A that detects the position of the pressure belt 16 in the belt-width direction, and a displacement mechanism that displaces one longitudinal (axial) end of the tension roller 17 in the vertical direction. In order to prevent the pressure belt 16 from deviating from a preset range while the pressure belt 16 is moving (during a fixing process), the controller (CPU) 600 actuates the displacement mechanism based on the detection result of the position sensor 17A so as to displace the tension roller 17 in the vertical direction. This prevents the edges of the pressure belt 16 from deteriorating as a result of the pressure belt 16 being misaligned in the belt-width direction.

Similar to the displacement mechanism for the tension roller 14, the displacement mechanism for the tension roller 17 may alternatively be configured to displace the opposite longitudinal ends of the tension roller 17 in opposite vertical directions.

A silicon-rubber pressure pad 18 is disposed at the entrance side of the nip region formed between the heating roller 11 and the pressure roller 15. A predetermined pressure (400 N in this embodiment) is applied between the pressure pad 18 and the pressure pad 19.

A belt separating mechanism serving as a contact/separation unit will now be described.

The belt separating mechanism includes a pressure arm 21 that tilts the pressure unit 2 about a pivot axis C, a pressure cam 22 for positioning the pressure arm 21, and a driving motor connected to the pressure cam 22.

Figure 4:
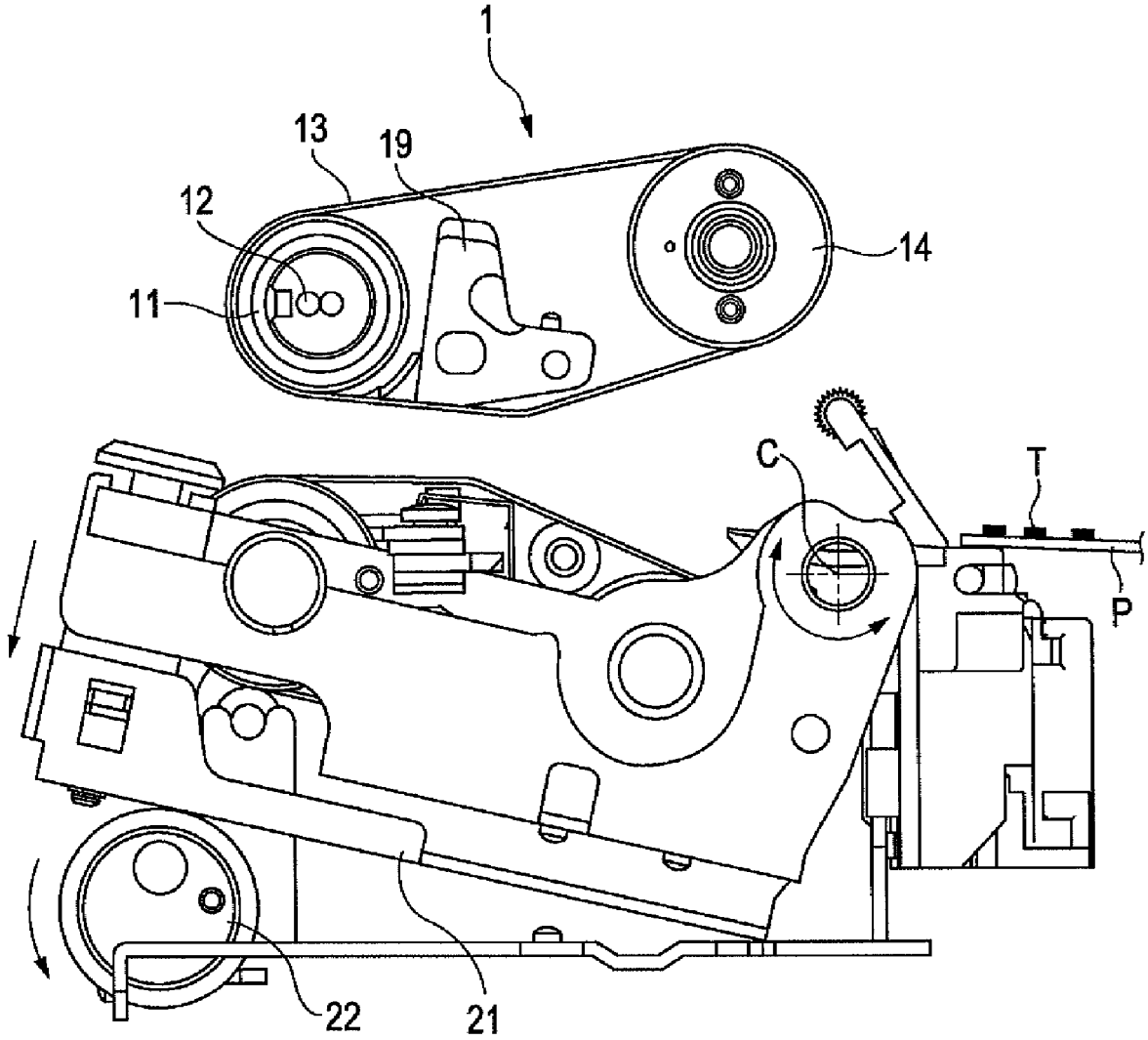
FIG. 4 is a schematic cross-sectional view of the fixing device according to the first embodiment in a state where the heating unit and the pressure unit thereof are separated from each other.
Figure 5:
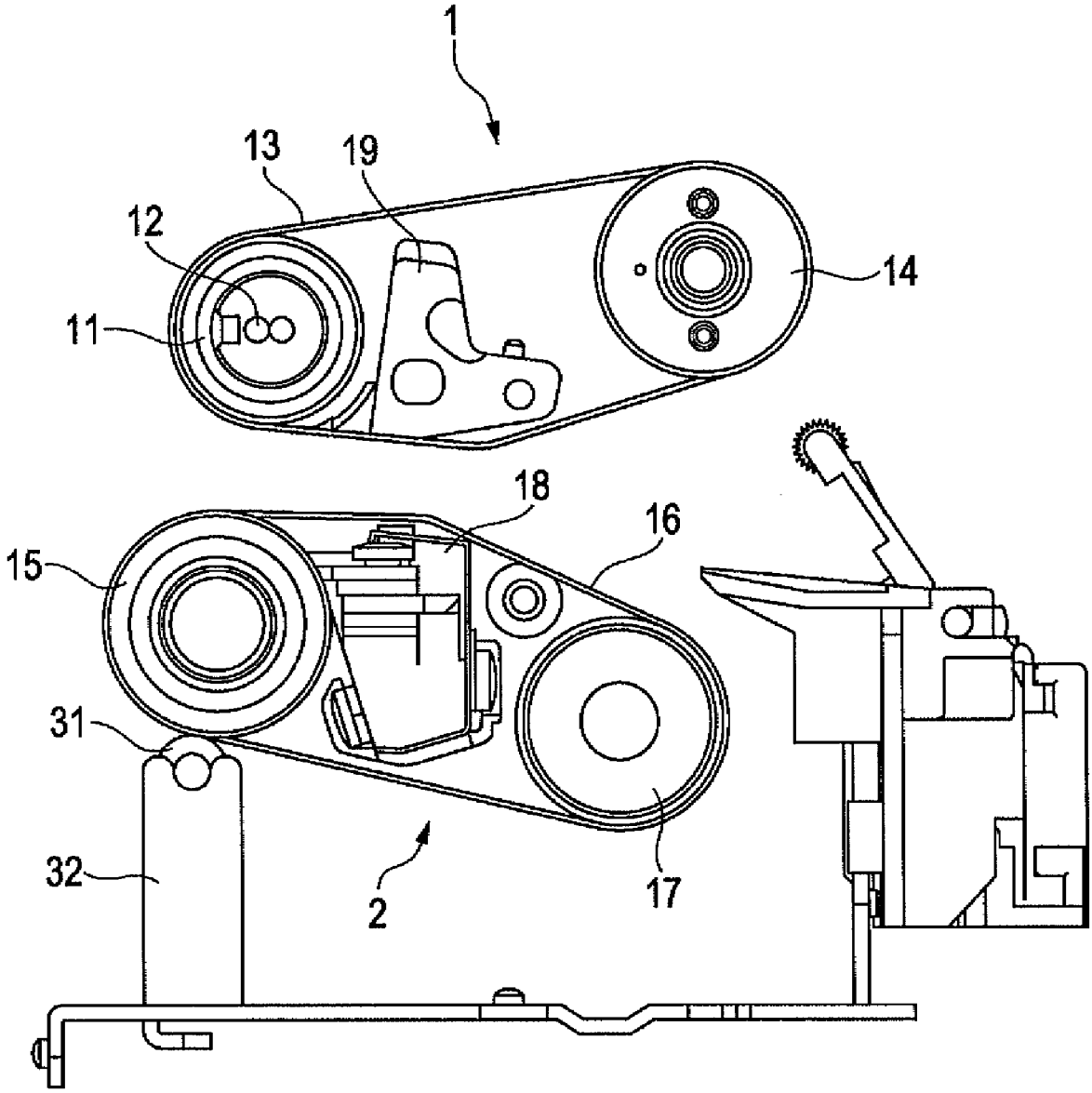
FIG. 5 is a schematic cross-sectional view of the fixing device according to the first embodiment in the state where the heating unit and the pressure unit thereof are separated from each other.

In order to separate the pressure belt 16 from the heating belt 13 as shown in FIGS. 4 and 5, the pressure cam 22 is rotated counterclockwise by the driving motor so that the pressure arm 21 moves downward. This belt separating mechanism is controlled by the controller 600. The controller 600 thereby controls the rotation of the driving motor.

Figure 2:
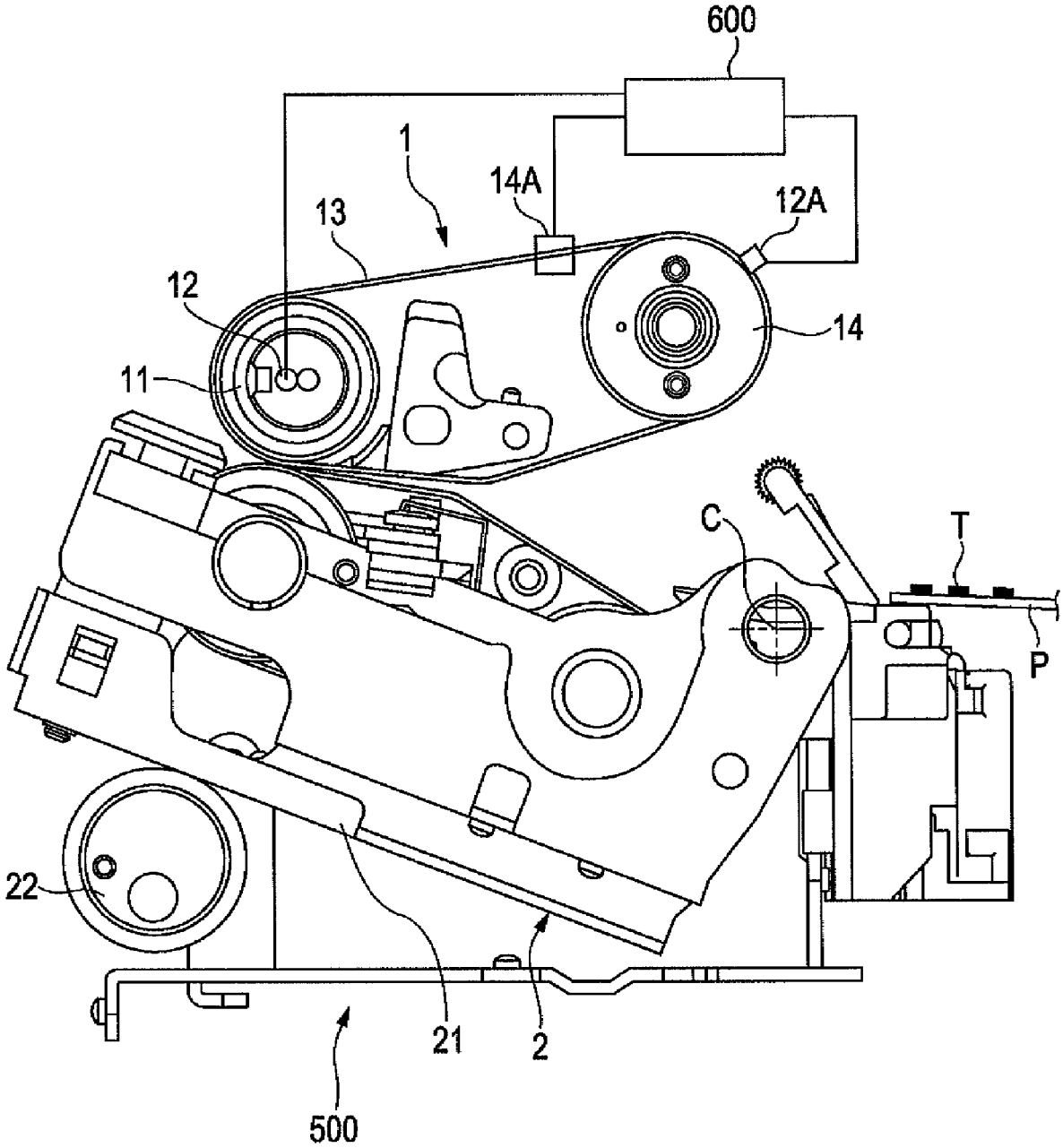
FIG. 2 is a schematic cross-sectional view of a fixing device according to the first embodiment in a state where a heating unit and a pressure unit thereof are held in pressure contact with each other.
Figure 3:
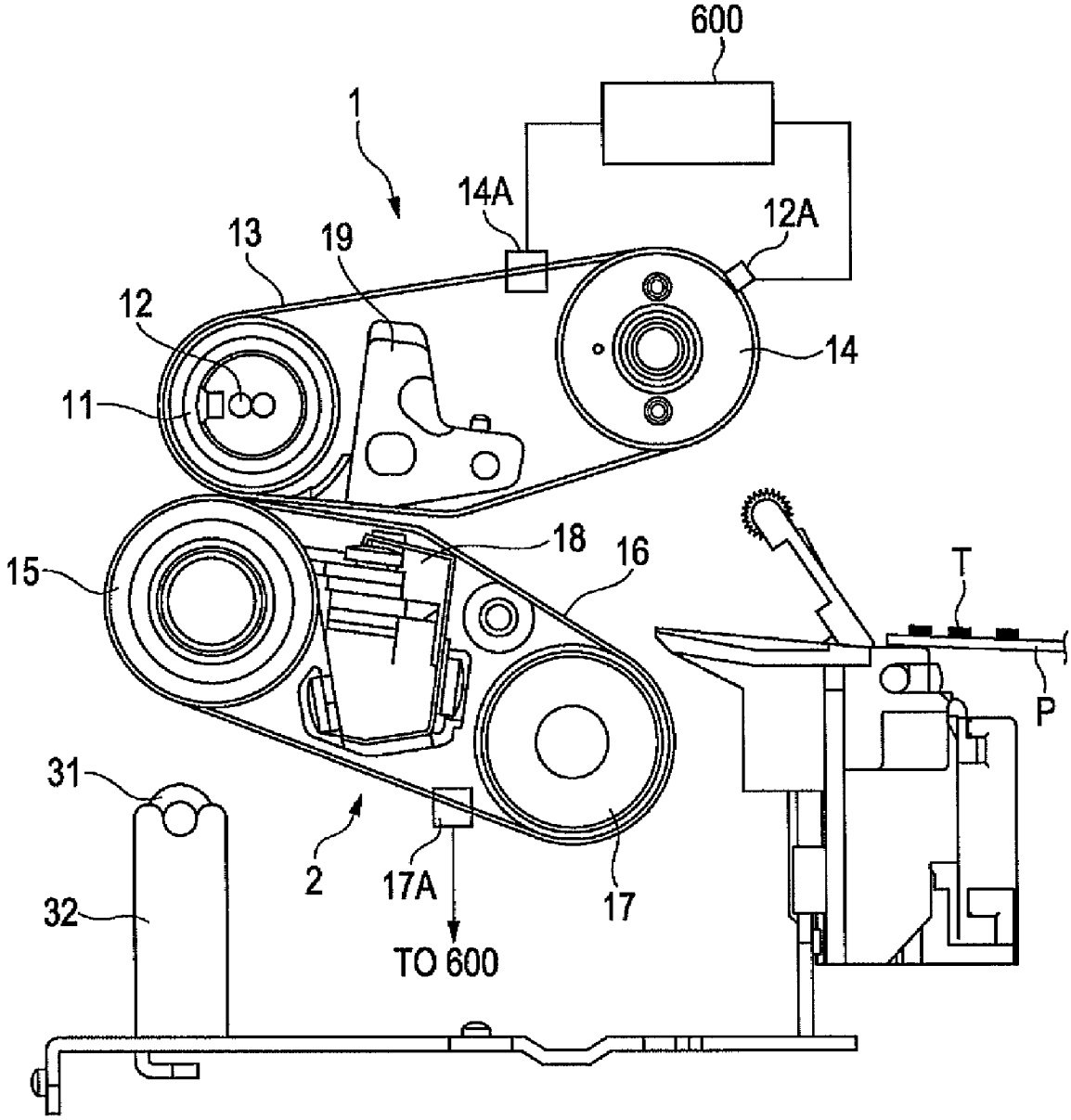
FIG. 3 is a schematic cross-sectional view of the fixing device according to the first embodiment in the state where the heating unit and the pressure unit thereof are held in pressure contact with each other.

To change the state shown in FIGS. 4 and 5 to the state shown in FIGS. 2 and 3, (that is, to bring the pressure belt 16 into pressure contact with the heating belt 13), the pressure cam 22 is rotated clockwise by the driving motor so that the pressure arm 21 moves upward.

Accordingly, the belt separating mechanism allows the heating belt 13 and the pressure belt 16 to be contactable and separable with respect to each other. Although this embodiment applies a configuration in which the contact/separation operations are performed by moving the pressure unit 2, alternative configurations are also permissible. For example, the contact/separation operations may be performed by moving the heating unit 1 or by moving both the heating unit 1 and the pressure unit 2.

Figure 20:
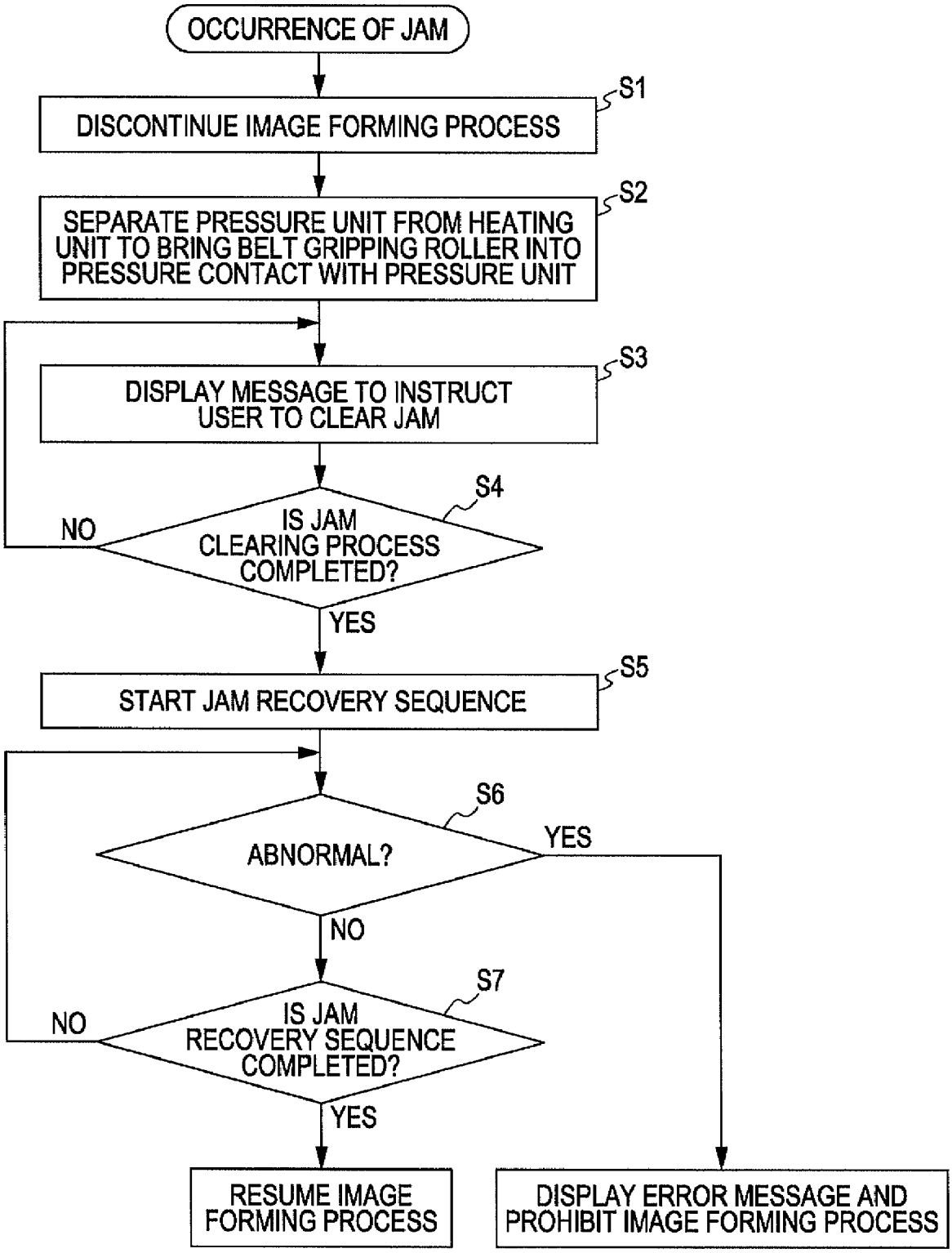
FIG. 20 is a flow chart of an operation performed in the event of a jam.

Sequence of Process from Occurrence of Jam up to Resuming of Image Forming Process A sequence of process from an occurrence of a jam up to resuming of an image forming process will be described below with reference to FIG. 20. In this sequence, the controlling of each of the units and devices is performed by the controller 600.

A mechanism that detects an occurrence of a jam in the fixing device 500 is described first.

This mechanism includes sheet passing sensors disposed at upstream and downstream sides of the fixing device 500 in the sheet conveying direction. Each of these sheet passing sensors is configured to detect whether a sheet P has passed through the point of detection by that sensor. The output signals from these sheet passing sensors are sent to the controller 600.

Following the detection of a sheet P by the upstream-side sheet passing sensor, when the downstream-side sheet passing sensor detects the passing of the sheet P within a set time period starting after the detection by the upstream-side sheet passing sensor, it is determined that the device 500 is in a normal condition. In this case, the fixing process is allowed to continue.

In contrast, following the detection of a sheet P by the upstream-side sheet passing sensor, if the downstream-side sheet passing sensor does not detect the passing of the sheet P after the set time period, it is determined that the device 500 is in an abnormal (jammed) condition. In that case, the fixing process is discontinued.

When a failure in the conveyance of a sheet P, namely, a jam, is detected, the operation proceeds to step S1 where the controller 600 immediately discontinues the image forming process (fixing process) and stops the heating belt 13 and the pressure belt 16 from rotating. In step S2, the controller 600 actuates the belt separating mechanism so as to move the pressure belt 16 away from the heating belt 13.

After these steps, the operation proceeds to step S3 where the user is instructed to clear the jam by removing the jammed sheet P from the fixing device 500. This instruction to the user is implemented by displaying the message "Please clear the jam" on a liquid-crystal display 700 (FIG. 1) serving as a control portion located at the top of the image forming apparatus 100. The controller 600 controls the liquid-crystal display 700 so that the above message is displayed on the liquid-crystal display 700.

Subsequently, the user can clear the jam by opening the front door of the apparatus 100. When the user clears the jam and closes the front door, the controller 600 determines in step S4 that the jam has been cleared.

Next, in step S5, a jam recovery sequence (jam recovery operation) begins. In detail, the heating belt 13 and the pressure belt 16 are rotated and the halogen heater 12 starts to adjust the temperature of the heating belt 13. At the same time, a belt-position checking sequence is also implemented for checking the positions of the heating belt 13 and the pressure belt 16. In detail, the position sensors 14A and 17A detect the positions of the heating belt 13 and the pressure belt 16, respectively.

In step S7, when the temperature of the heating belt 13 has reached the set temperature, (target temperature), the controller 600 terminates the jam recovery sequence.

With the termination of the jam recovery sequence, the controller 600 actuates the belt separating mechanism so as to bring the pressure belt 16 into pressure contact with the heating belt 13. Thus, the previously discontinued image forming process is allowed to resume.

In the course of this jam recovery operation, if the recording material, (sheet P), has not been properly removed or if the pressure belt 16 is detected to be at a position outside the preset range, it is determined in step S6 that the device 500 is in an abnormal condition. When the device 500 is determined to be in an abnormal condition, an "error" message is displayed on the liquid-crystal display 700. In this case, the image forming process is prohibited.

In this embodiment, the series of preparation steps required before executing the fixing process, which are performed from the time the jam has been cleared to the time the image forming process is allowed to resume, are referred to as a "jam recovery operation".

Belt-Movement Restricting Mechanism

A belt-movement restricting mechanism (restricting unit) is described next. This mechanism is provided for preventing the pressure belt 16 from deviating from the preset range in its width direction, which can be caused when the user tries to clear a jam by pulling the sheet P attached to the pressure belt 16 sideways or slantwise.

The belt-movement restricting mechanism according to this embodiment includes a belt gripping roller 31 and a support base 32 that rotatably supports the belt gripping roller 31. The support base 32 is fixed to a housing of the fixing device 500.

The belt gripping roller 31 is a hollow core-metal roller coated with silicon rubber and is long enough to be entirely contactable with the pressure belt 16 in the belt-width direction. When in operation, the belt gripping roller 31 together with the pressure roller 15 grip the pressure belt 16 between them. The gripping pressure generated in this case is 150 N in this embodiment.

In the state where the pressure belt 16 is in pressure contact with the heating belt 13 (normal fixing state), the belt gripping roller 31 is disposed distant from the pressure belt 16, as shown in FIG. 3.

Referring to FIGS. 4 and 5, when the belt separating mechanism moves the pressure unit 2 away from the heating unit 1 due to an occurrence of a jam, the belt gripping roller 31 located below the pressure roller 15 comes into pressure contact with the pressure belt 16. In this embodiment, the pressure roller 15 is used as a backup roller (rotary member) for contributing to an effective restriction of the belt movement by the belt gripping roller 31. This eliminates the need for an additional backup roller and can thus allow for cost reduction of the apparatus 100. Alternatively, as long as the pressure belt 16 can be prevented from moving in its width direction during the jam clearing process, a backup roller like the pressure roller 15 is not necessarily required. In that case, however, the belt gripping roller 31 will require a greater pressure contact force. Therefore, the former configuration that uses a backup roller is believed to provide a longer lifespan for the pressure belt 16.

When the pressure belt 16 receives a force in its width direction during the jam clearing process, the gripping pressure from the belt gripping roller 31 can prevent the pressure belt 16 from moving in its width direction. This means that the pressure belt 16 can be maintained within the preset range even during the jam clearing process, whereby the jam recovery operation can be performed properly. The discontinued image forming process is thus allowed to resume quickly.

In contrast, if the belt-movement restricting mechanism according to this embodiment were not provided, there would be a possibility that the pressure belt 16 would deviate from the preset range during a jam clearing process. Should this happen, an error would occur in the belt-position checking sequence of a jam recovery operation, thus making it difficult to resume the image forming process. Specifically, this is because the position of the pressure belt 16 would not be detected properly when the pressure belt 16 is positioned beyond the detection range of the position sensor 17A. In such a condition, the controller 600 would determine that the device 500 is in an abnormal condition, discontinue the jam recovery operation, and allow the liquid-crystal display 700 to display an error message.

In the present invention, when a jam recovery operation is started upon proper implementation of the jam clearing process, the belt gripping roller 31 and the pressure belt 16 are separated from each other in conjunction with moving of the pressure unit 2 into pressure contact with the heating unit 1. Accordingly, this prevents the pressure belt 16 from requiring a large load for rotation during the normal fixing process.

With this configuration according to this embodiment, the belt-movement restricting mechanism that employs the belt gripping roller 31 defined by a rotary member facilitates the jam clearing process performed by the user. Even when the pressure belt 16 receives a force in its moving direction as the sheet P is being peeled off the pressure belt 16, the surface of the pressure belt 16 can be prevented from being deteriorated because the belt gripping roller 31 is rotatable with respect to the pressure belt 16. In addition, since the pressure belt 16 in the restricted state is still allowed to move slightly in its moving direction in this embodiment, only a small force is required for pulling the sheet P.

As described above, in this embodiment, the belt gripping roller 31 is fixed to the housing of the fixing device 500 such that the belt gripping roller 31 is pressure contactable with the pressure belt 16 when the pressure belt 16 is separated from the heating belt 13. Alternatively, for example, the belt gripping roller 31 may be configured to be movable in the vertical direction, such that the belt gripping roller 31 can be moved into pressure contact with the pressure belt 16 in the event of a jam. In that case, the controller 600 can move the belt gripping roller 31 into pressure contact with the pressure belt 16 within a time period starting from the time a jam has occurred to the time the user is instructed to clear the jam. As a mechanism for moving the belt gripping roller 31, a known mechanism with a configuration similar to that of the belt separating mechanism may be used.

Although the belt-movement restricting mechanism is configured to restrict the movement of the pressure belt 16 in this embodiment, the following alternative configurations are also permissible. Specifically, an alternative configuration equipped with a belt-movement restricting mechanism for the heating belt 13 is also permissible. In that case, the belt-movement restricting mechanism is configured to restrict the movement of the heating belt 13. As a further alternative, a belt-movement restricting mechanism may be provided for each of the heating belt 13 and the pressure belt 16.

Second Embodiment

A second embodiment will be described below with reference to FIGS. 6 and 7. The components shown in FIGS. 6 and 7 that have the same functions as, or alternatively similar functions to, those in the first embodiment are given the same reference numerals. Specifically, the second embodiment is characterized in that the belt-movement restricting mechanism (restricting unit) is defined by a belt-position restricting plate 41. The remaining components in the second embodiment are the same as those in the first embodiment.

Figure 6:
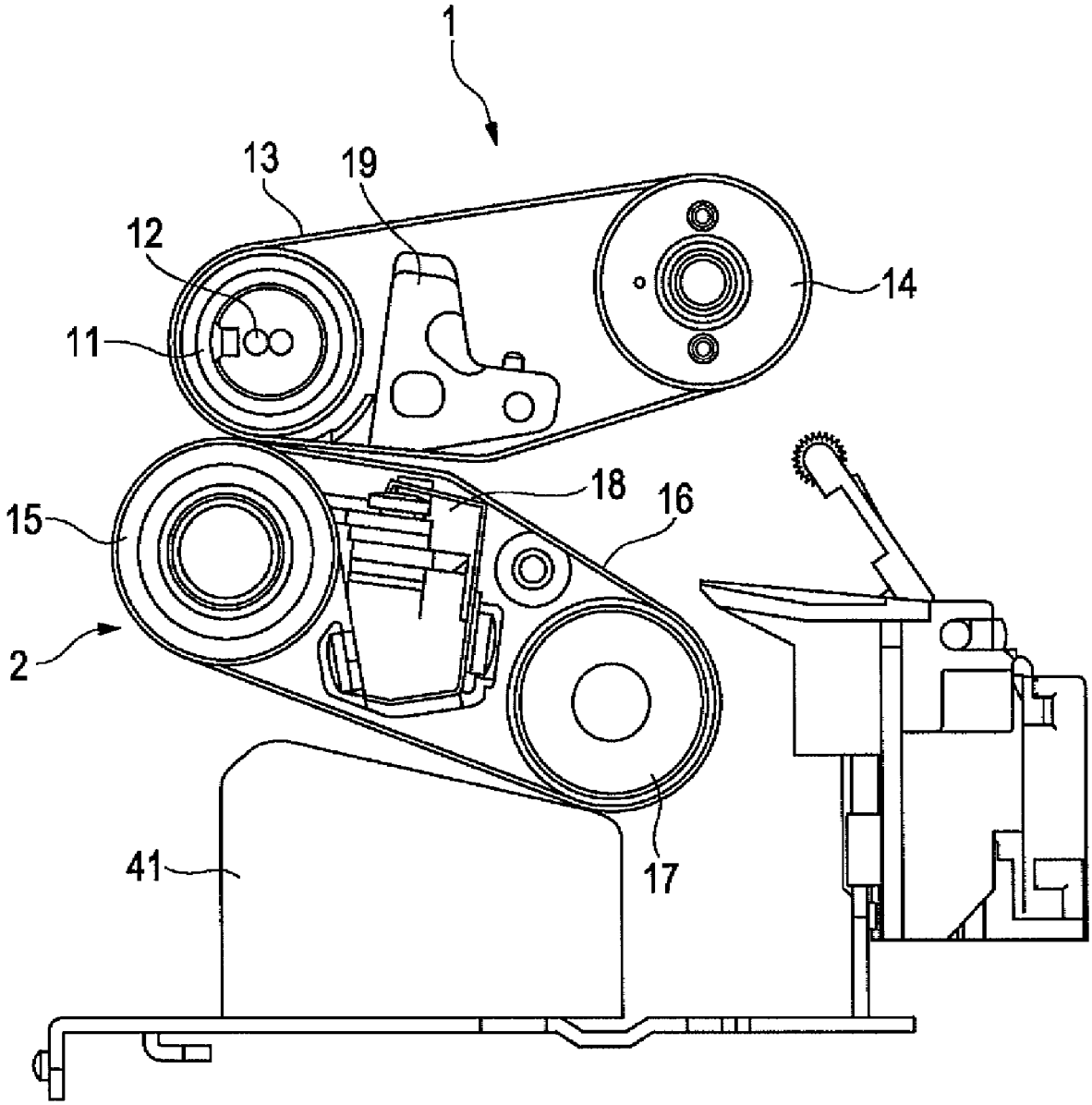
FIG. 6 is a schematic cross-sectional view of a fixing device according to a second embodiment of the present invention in a state where a heating unit and a pressure unit thereof are held in pressure contact with each other.
Figure 7:
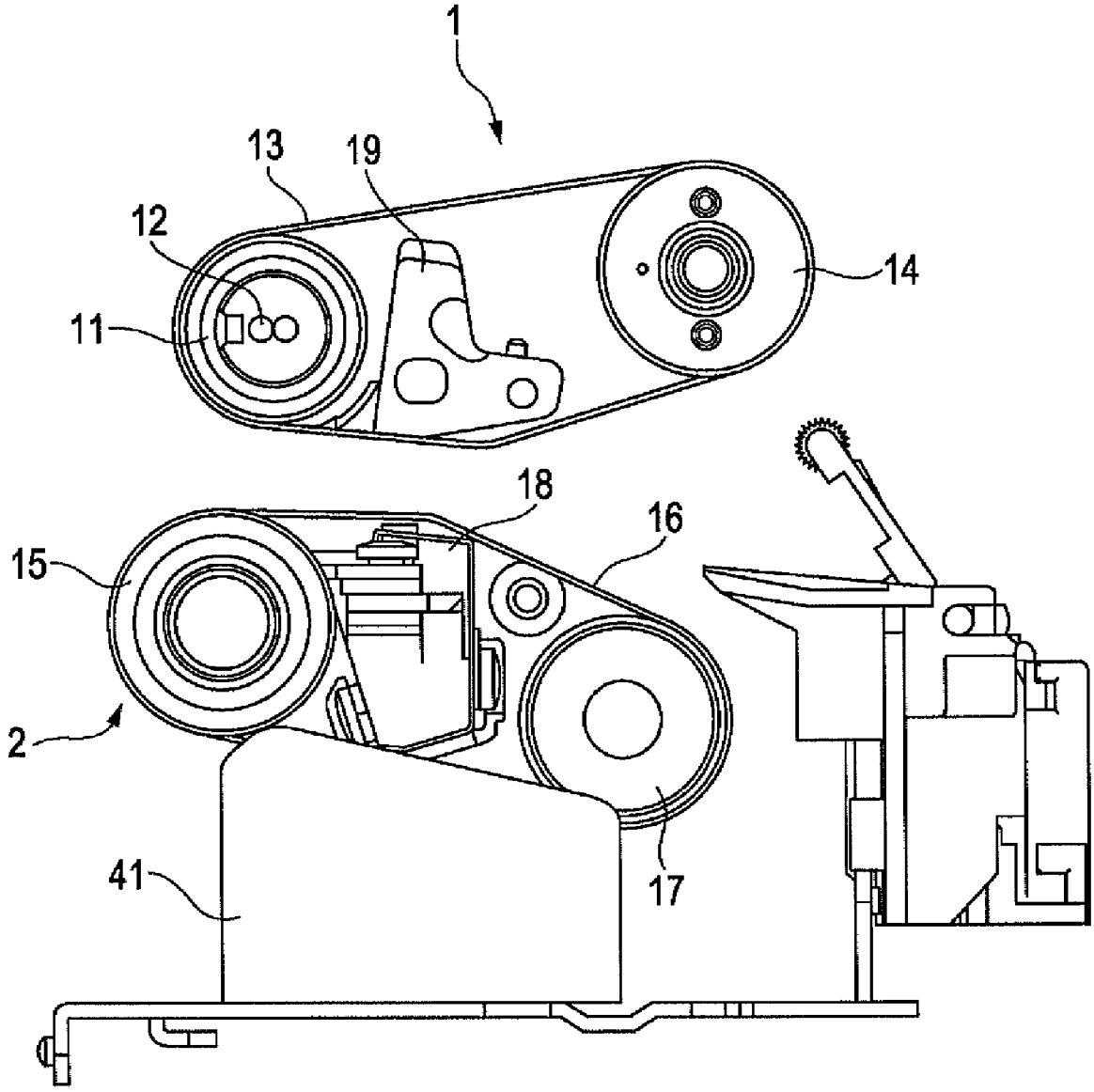
FIG. 7 is a schematic cross-sectional view of the fixing device according to the second embodiment in a state where the heating unit and the pressure unit thereof are separated from each other.

Referring to FIGS. 6 and 7, a belt-position restricting plate 41 is immovably attached to the housing of the fixing device 500. The material used for the belt-position restricting plate 41 may be, for example, resin or steel, but is not limited as long as the material has strength necessary for restricting the position of the pressure belt 16. In this embodiment, the belt-position restricting plate 41 is composed of steel.

The belt-position restricting plate 41 is disposed outside the pressure belt 16 as viewed in the width direction. In the state where the pressure belt 16 is in pressure contact with the heating belt 13, the belt-position restricting plate 41 is disposed out of contact with the pressure belt 16. On the other hand, at the time of a jam clearing process, the belt-position restricting plate 41 is contactable with an edge of the pressure belt 16 as viewed in the width direction.

In detail, in the state as shown in FIG. 7 where the pressure unit 2 is moved away from the heating unit 1 by the belt separating mechanism in response to an occurrence of a jam, the pressure belt 16 and the belt-position restricting plate 41 overlap each other as viewed from a direction perpendicular to the plane of drawing in FIG. 7. The belt-position restricting plate 41 is thus positioned where it is contactable with the edge of the pressure belt 16. Accordingly, as in the first embodiment, the pressure belt 16 can be prevented from deviating from the preset range in its width direction during the jam clearing process, whereby the discontinued image forming process is allowed to resume quickly without delay.

In this embodiment, the belt-position restricting plate 41 shown in FIGS. 6 and 7 is also disposed adjacent to the other edge of the pressure belt 16 as viewed in the width direction. With these two belt-position restricting plates 41, the movement of the pressure belt 16 can be restricted.

Consequently, even when the pressure belt 16 receives a force in its width direction during the jam clearing process, the pressure belt 16 in abutment with the belt-position restricting plates 41 can be properly maintained within the preset range.

In this embodiment, the belt-position restricting plates 41 immovably disposed on the housing of the fixing device 500 are relatively moved with respect to the pressure belt 16 towards a position for restricting the position of the pressure belt 16. This relative movement of the belt-position restricting plates 41 is implemented in conjunction with the separation of the pressure belt 16 from the heating belt 13. Alternatively, this embodiment may be equipped with a designated mechanism for moving the belt-position restricting plates 41. In that case, the mechanism may be configured to move the belt-position restricting plates 41 to where the plates 41 are contactable with the edges of the pressure belt 16 in the event of a jam.

Although the belt-position restricting plates 41 are configured to restrict the movement of the pressure belt 16 in this embodiment, the following alternative configurations are also permissible. Specifically, an alternative configuration equipped with belt-position restricting plates for the heating belt 13 is also permissible. In that case, these belt-position restricting plates are configured to restrict the movement of the heating belt 13. As a further alternative, belt-position restricting plates may be provided for each of the heating belt 13 and the pressure belt 16.

Third Embodiment

Figure 8:
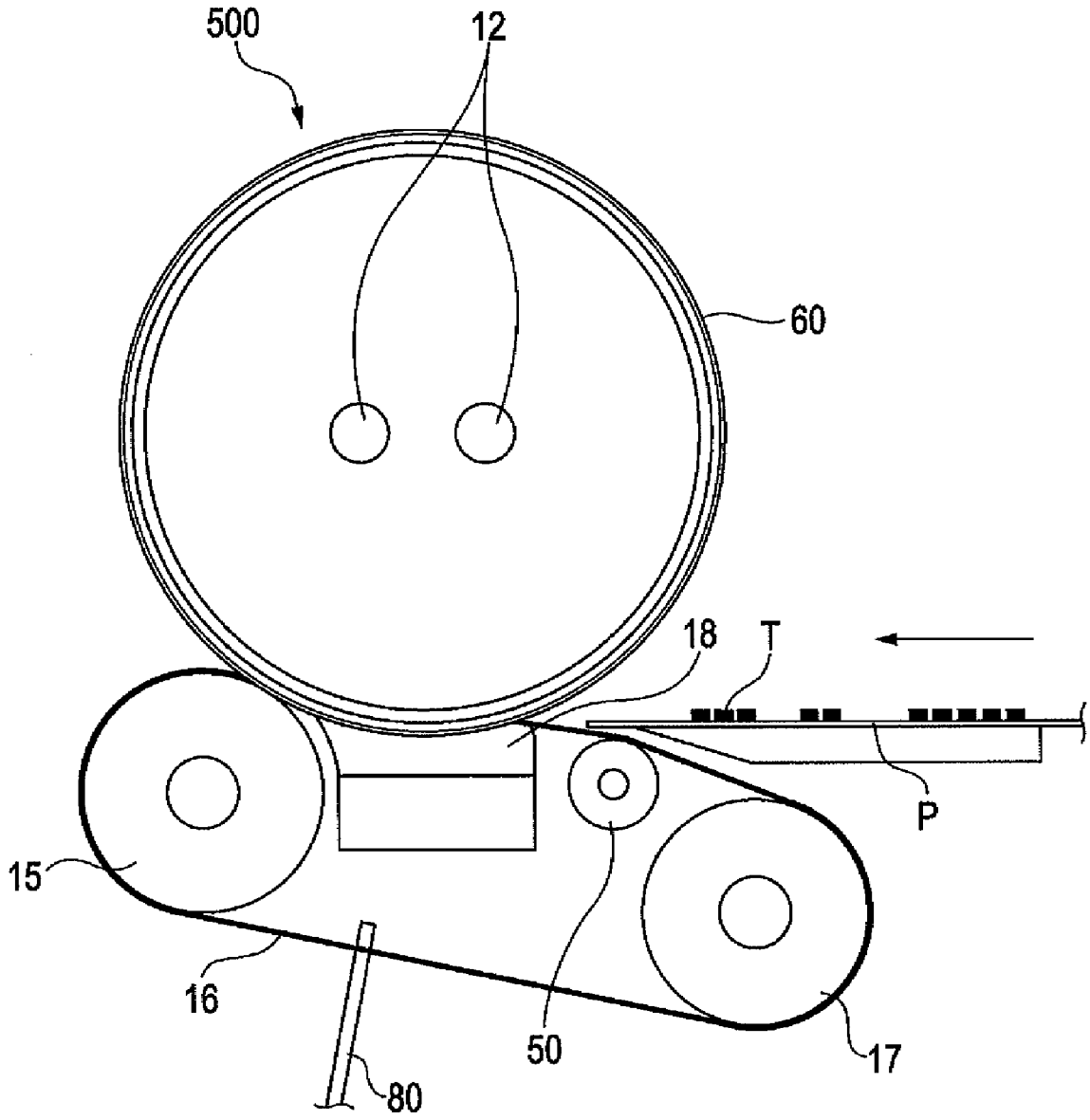
FIG. 8 is a schematic cross-sectional view of a fixing device according to a third embodiment of the present invention.

A third embodiment will now be described with reference to FIG. 8. A fixing device 500 serving as an image heating device according to the third embodiment is equipped with a heating roller and a pressure belt. The components included in this embodiment that have the same functions as, or alternatively similar functions to, those in the above embodiments are given the same reference numerals.

The third embodiment is characterized in that the belt-movement restricting mechanism is defined by a belt-position restricting plate 201. The remaining components in the third embodiment are the same as those in the first embodiment.

First, the fixing device 500 equipped with a heating roller and a pressure belt will be briefly described.

The heating unit 1 includes a heating roller 60 and a halogen heater 12 disposed inside the heating roller 60. As in the first embodiment, the controller 600 controls the electricity supplied to the halogen heater 12 so that the surface of the heating roller 60 can be maintained at a set temperature, i.e. target temperature.

The heating roller 60 has a metallic core made of an aluminum cylindrical tube having an outside diameter of 56 mm and an inside diameter of 50 mm, and contains the halogen heater 12 inside this metallic core. In the heating roller 60, the surface of the metallic core is coated with an elastic layer having a thickness of 2 mm and composed of silicon rubber having an Asker C hardness of 45°, and the surface of the elastic layer is coated with a PFA or PTFE heat-resistant release layer.

The pressure unit 2 has a similar configuration to that in the first embodiment, and includes a pressure belt 16, a pressure roller 15, a tension roller 17, a pressure pad 18, and an oil application roller 50. The pressure belt 16 is suspended between the pressure roller 15 and the tension roller 17 in an annularly rotatable fashion at a predetermined tension of, for example, 100 N.

The oil application roller 50 can apply oil to the inner surface of the pressure belt 16 to reduce sliding resistance between the inner surface of the pressure belt 16 and the pressure pad 18. The oil used in this case may be heat-resistant silicon oil having a viscosity of 1000 cS. The oil application roller 50 is impregnated with this oil and is rotatably supported by the pressure belt 16.

A misalignment-correction control mechanism (sideways sliding unit) for the pressure belt 16 according to this embodiment will be described below with reference to FIG. 9.

A supporting arm 454 is rotatably supported by a shaft 455 fixed to an outer face of a side plate 420. The supporting arm 454 holds a spring 456. The spring 456 biases a tension-roller shaft bearing 453 in the suspended direction of the pressure belt 16, such that the shaft bearing 453 is movable in the suspended direction. The shaft bearing 453 supports the tension roller 17 in a rotatable manner.

A fan-shaped gear 452 is fixed to an outer area of the supporting arm 454. The fan-shaped gear 452 is meshed with a worm 451 which can be rotatably driven by a stepping motor 450. A position detecting mechanism 80 (FIG. 8) that can detect the position of the pressure belt 16 in its width direction (that is, a direction parallel to directions indicated by arrows F and R in FIG. 9) is disposed near an edge of the pressure belt 16 as viewed in the width direction.

Figure 9:
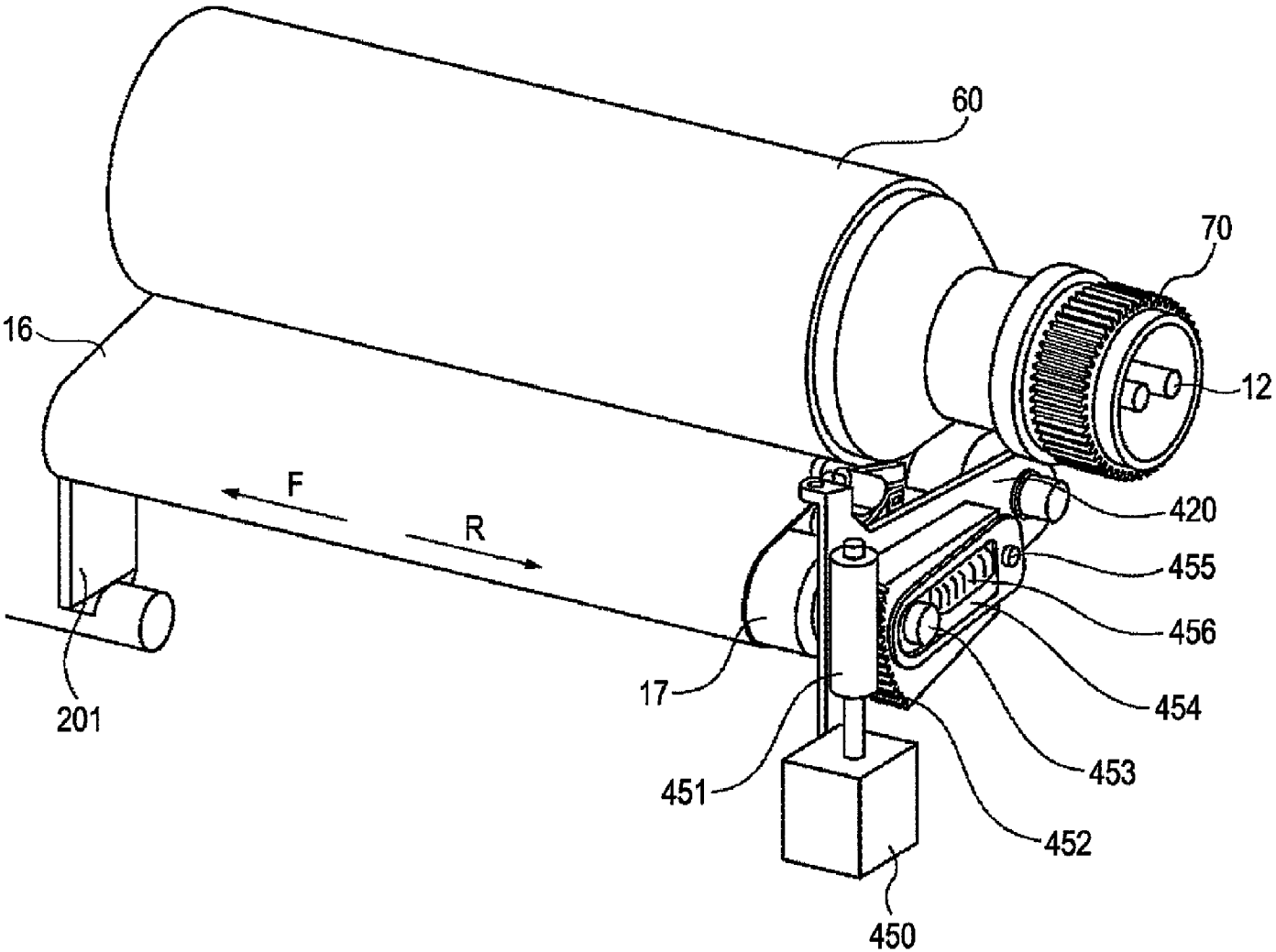
FIG. 9 is a schematic perspective view of the fixing device according to the third embodiment.

Reference numeral 70 in FIG. 9 indicates a drive input gear that receives a driving force for rotating the heating roller 60.

Figure 10:
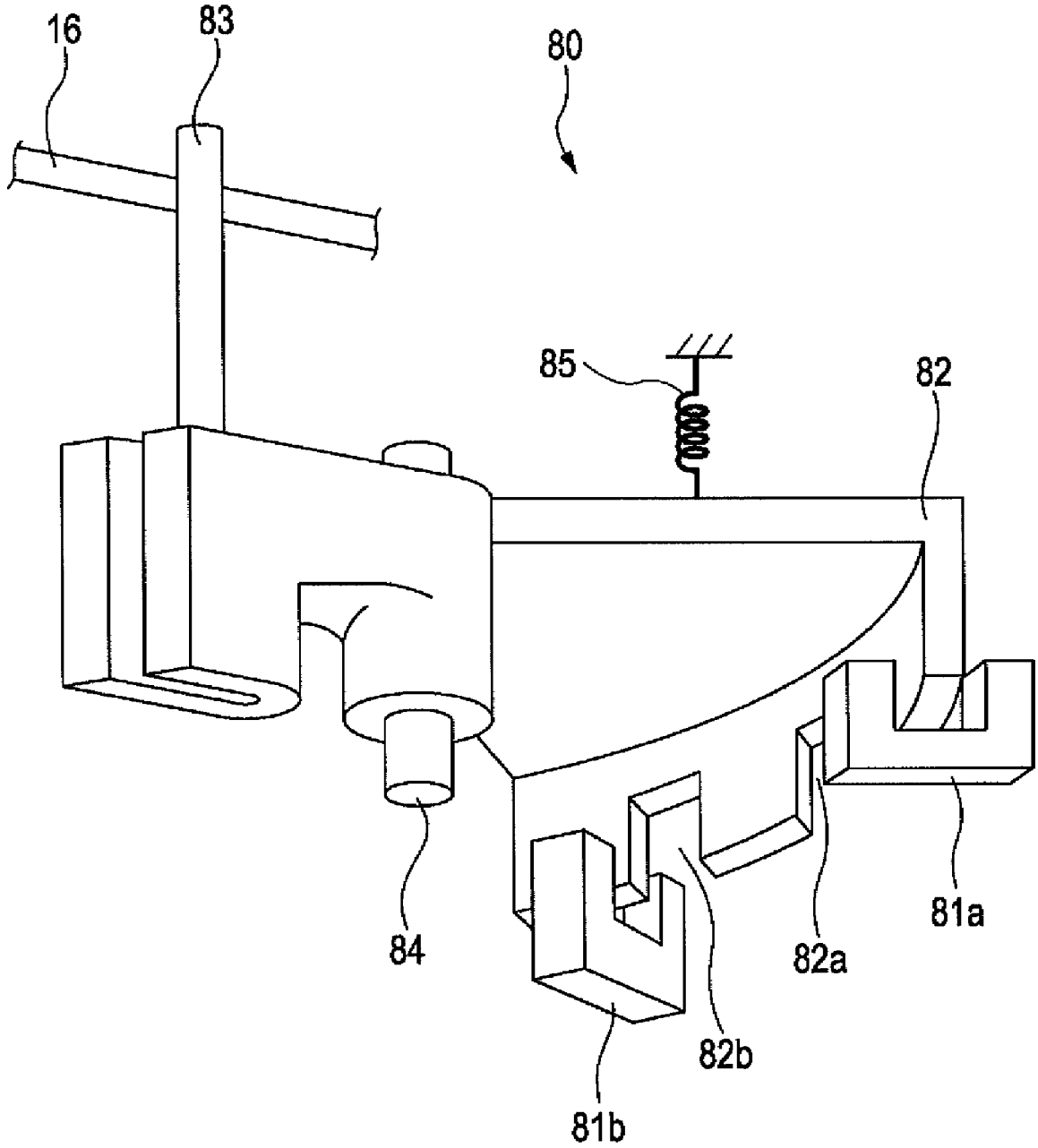
FIG. 10 is a schematic perspective view of a position detecting mechanism according to the third embodiment.
Figure 11:
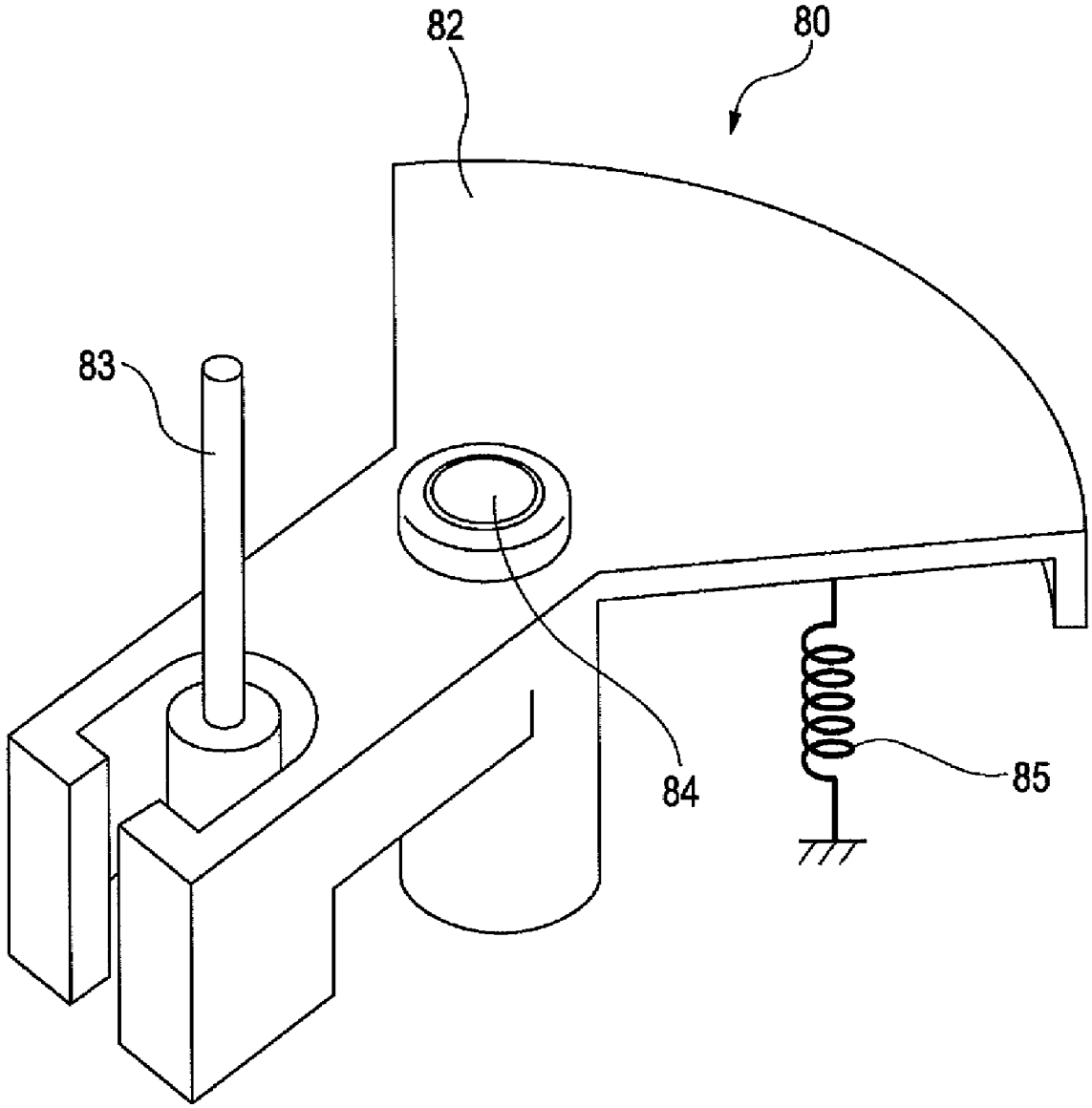
FIG. 11 is a schematic perspective view of the position detecting mechanism according to the third embodiment.

The position detecting mechanism 80 is now described with reference to FIGS. 10 and 11. FIG. 11 shows the position detecting mechanism 80 as viewed from below.

The position detecting mechanism 80 includes a belt-position detecting arm 83 and a sensor flag 82. The position detecting mechanism 80 is rotatable about a rotary shaft 84. The belt-position detecting arm 83 is biased by a bias spring 85 so as to be constantly in contact with an edge of the pressure belt 16 in the width direction. The sensor flag 82 has two cutouts 82*a* and 82*b*.

The belt-position detecting arm 83 and the sensor flag 82 follow the movement of the pressure belt 16 in the F direction and the R direction (FIG. 9) by rotating about the rotary shaft 84.

The position detecting mechanism 80 also includes two photo sensors 81*a* and 81*b*.

The position detecting mechanism 80 detects the position of the pressure belt 16 in the width direction by allowing the photo sensors 81*a* and 81*b* to respectively face the cutouts 82*a* and 82*b* in the sensor flag 82 as the pressure belt 16 moves in the F direction and the R direction.

In detail, the photo sensors 81*a* and 81*b* are so-called photo interrupters. Specifically, when light beams output from these photo sensors 81*a* and 81*b* are in an unblocked state as a result of the photo sensors 81*a* and 81*b* being disposed facing the respective cutouts 82*a* and 82*b*, the photo sensors 81*a* and 81*b* send out signals, i.e. ON/OFF signals.

In this embodiment, the controller 600 determines the position of the pressure belt 16 on the basis of a combination of ON/OFF signals from the two photo sensors 81*a* and 81*b* shown in Table 1. Based on the determined position of the pressure belt 16, the tension roller 17 is displaced in the vertical direction.

TABLE 1

| Condition of Belt | Out-of-Range Misalignment Error | Misaligned | Centrally Aligned | Misaligned | Out-of-Range Misalignment Error |
|---|---|---|---|---|---|
| Direction of Misalignment | F | F | | R | R |
| Photo Sensor 81a | ON | ON | OFF | OFF | ON |
| Photo Sensor 81b | ON | OFF | OFF | ON | ON |

In detail, when the pressure belt 16 slides lopsidedly in the direction of the arrow R (FIG. 9), the position detecting mechanism 80 detects an "R-direction misaligned" condition of the pressure belt 16, and sends the detected information to the controller 600. The controller 600 then performs control to rotate the stepping motor 450, so that the fan-shaped gear 452 is moved upward about the shaft 455.

As a result, the pressure belt 16 moves in the opposite direction, that is, in the F direction in FIG. 9.

In contrast, when the position detecting mechanism 80 detects an "F-direction misaligned" condition of the pressure belt 16, the position detecting mechanism 80 sends the detected information to the controller 600. The controller 600 then performs control to rotate the stepping motor 450, so that the fan-shaped gear 452 is moved downward about the shaft 455.

By repeating a series of these control operations, the pressure belt 16 can be slid sideways so as to be maintained within the preset range.

If by any possibility an "out-of-range misalignment error" condition is detected, the controller 600 receiving the detected information will immediately perform control to discontinue the fixing process and to display an error message on the liquid-crystal display 700 serving as a control portion.

A mechanism for moving the pressure belt 16 into and out of contact with the heating roller 60 is described below with reference to FIG. 12.

Figure 12:
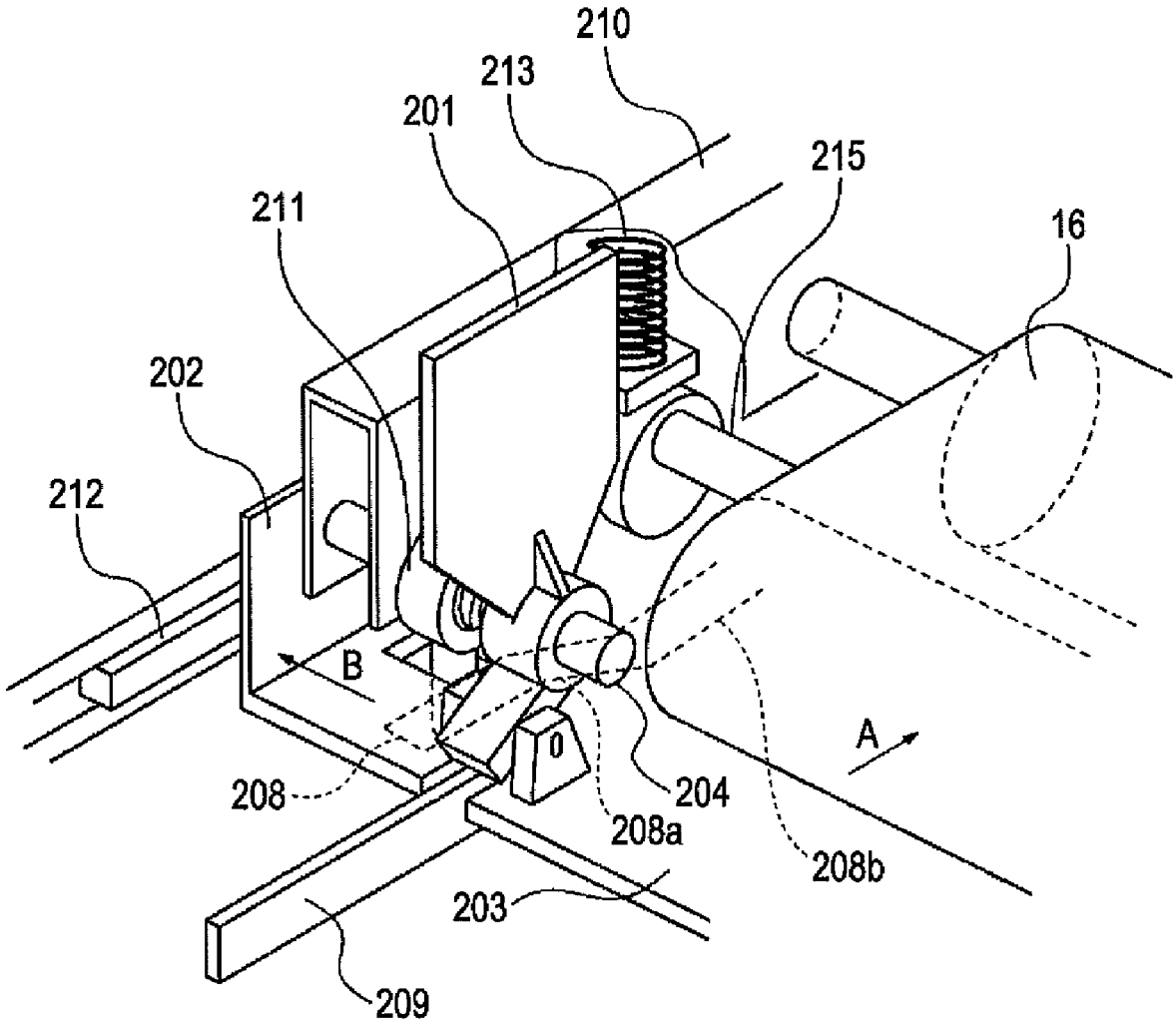
FIG. 12 is a schematic perspective view showing one side of the fixing device according to the third embodiment.

Referring to FIG. 12, a shaft 204 extends out from a side plate 202 which is integrated with a bottom plate 203 that supports the entire fixing device 500. A rotary plate 210 is provided in a rotatable fashion about the shaft 204. The rotary plate 210 is supported from below by a cam 215 via a pressure spring 213. Furthermore, the rotary plate 210 rotatably supports the pressure roller 15 and allows the pressure roller 15 to be movable in the vertical direction about the shaft 204.

The cam 215 is rotatably controlled by a stepping motor (not shown). For example, when the fixing device 500 is not performing a fixing process on a sheet P, the rotary plate 210 is moved to a position for separating the pressure unit 2 from the heating roller 60.

The cam 215, the rotary plate 210, and the pressure spring 213 are similarly provided adjacent to the other edge of the pressure belt 16 as viewed in the width direction, and are similarly used for the vertical movement of the pressure unit 2 (i.e. pressure roller 15).

Jam Clearing Process

A structure and operation for performing a jam clearing process will be described below. The sequence of a jam clearing process is the same as that explained above with reference to FIG. 20.

If a sheet P is stopped (jammed) while being nipped between the pressure belt 16 and the heating roller 60, the controller 600 immediately stops the heating operation and the rotary operation performed on the heating roller 60. The controller 600 also controls the rotation of the cam 215 so that the pressure unit 2 is moved away from the heating roller 60.

Figure 13:
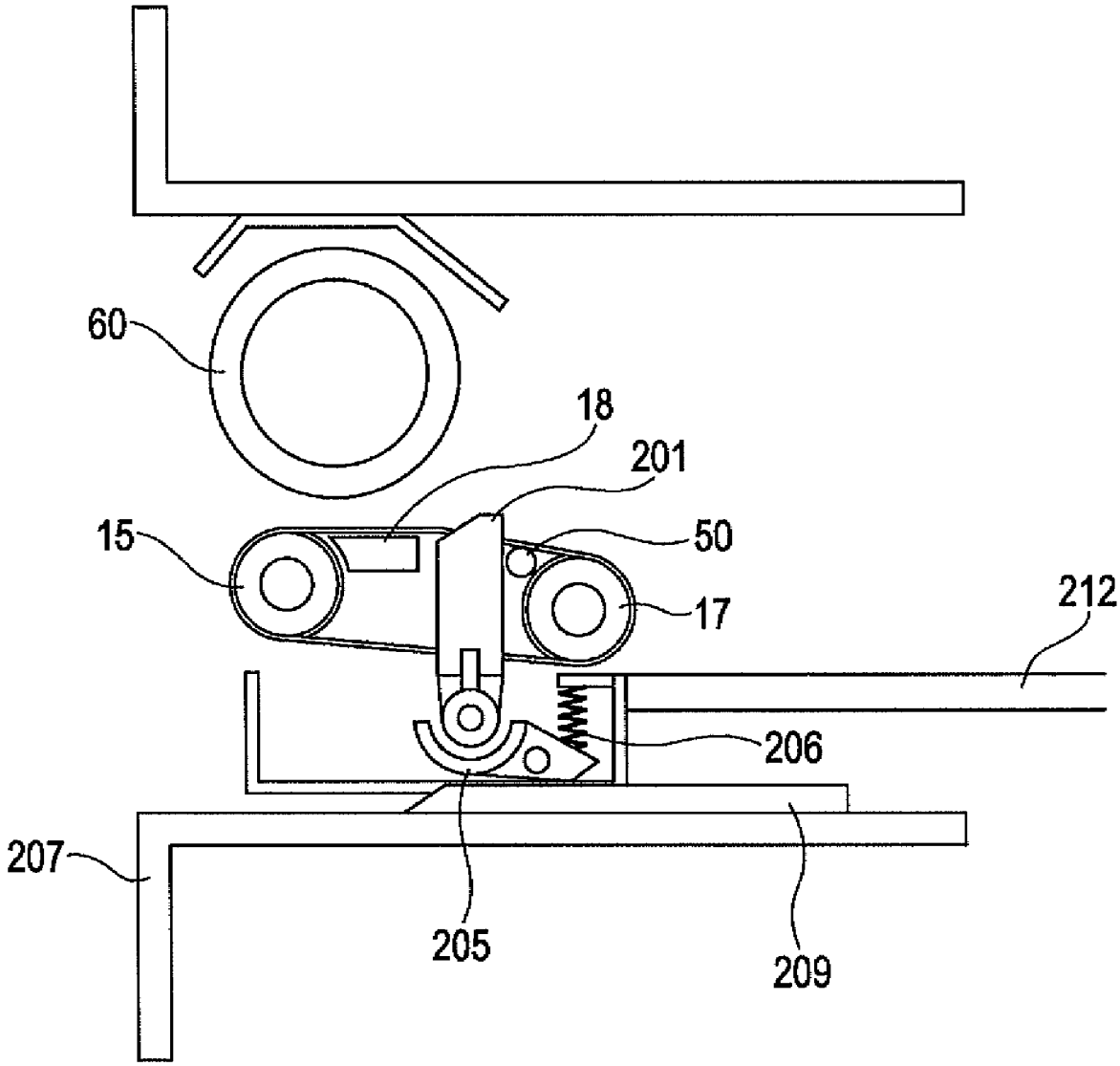
FIG. 13 is a schematic cross-sectional view showing a state where the fixing device according to the third embodiment is accommodated within a main body of the image forming apparatus.
Figure 14:
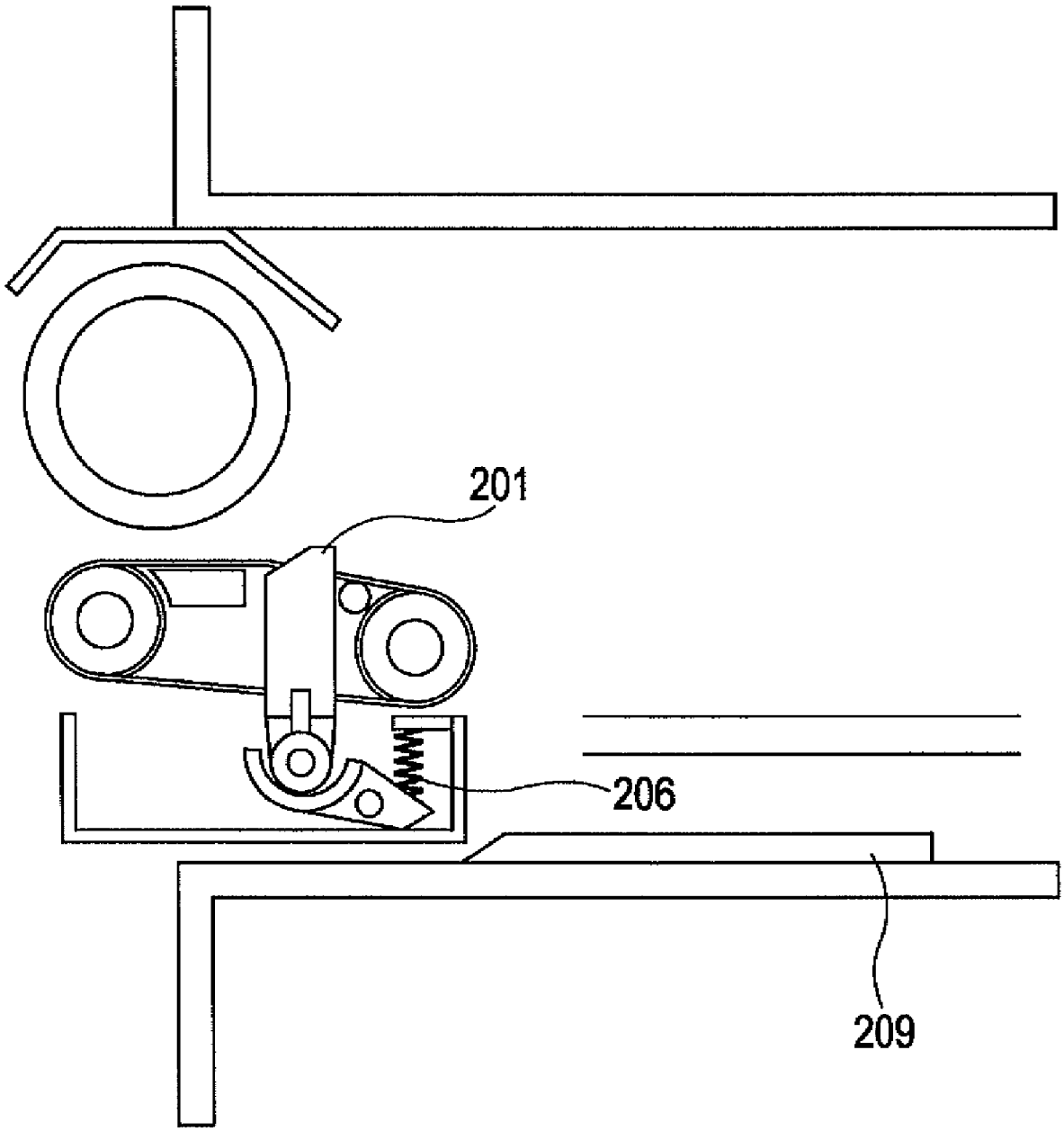
FIG. 14 is a schematic cross-sectional view showing a state where the fixing device according to the third embodiment is ejected from the main body of the image forming apparatus.

The fixing device 500 according to this embodiment is slidably supported relative to the main body of the image forming apparatus 100 by means of a slider 212, such that the fixing device 500 can be ejected from the main body of the image forming apparatus 100 as shown in FIGS. 13 and 14. In other words, the image forming apparatus 100 at least has an ejection mechanism (ejection unit) that is ejectable from the main apparatus body while holding the fixing device 500. Accordingly, in the event of a jam, the user can remove the jammed sheet by ejecting the fixing device 500 from the apparatus 100.

Belt-Movement Restricting Mechanism

The configuration of the belt-movement restricting mechanism that restricts a lateral movement of the pressure belt 16 during a jam clearing process is described below.

Figure 15:
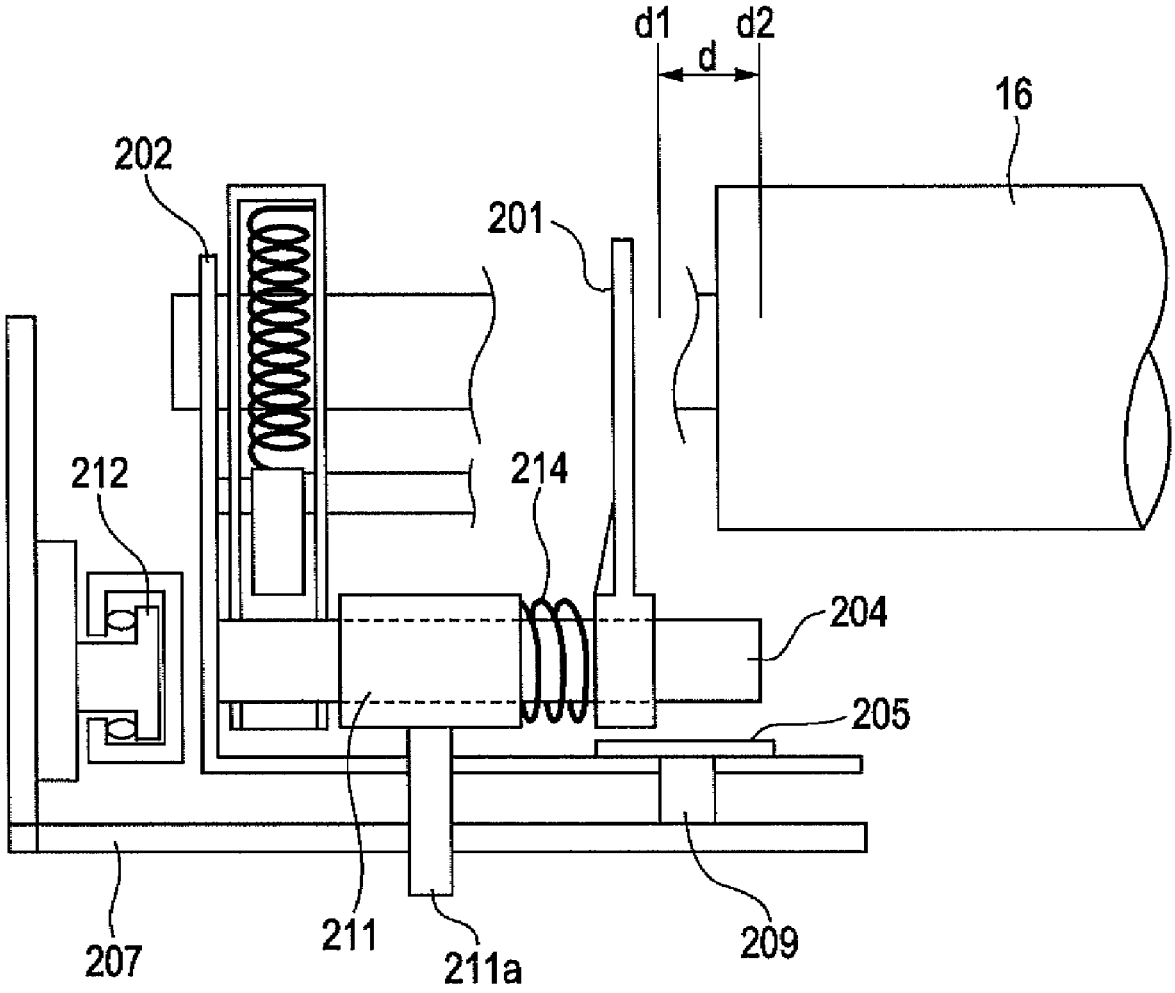
FIG. 15 is a schematic cross-sectional view showing one side of the fixing device according to the third embodiment.
Figure 16:
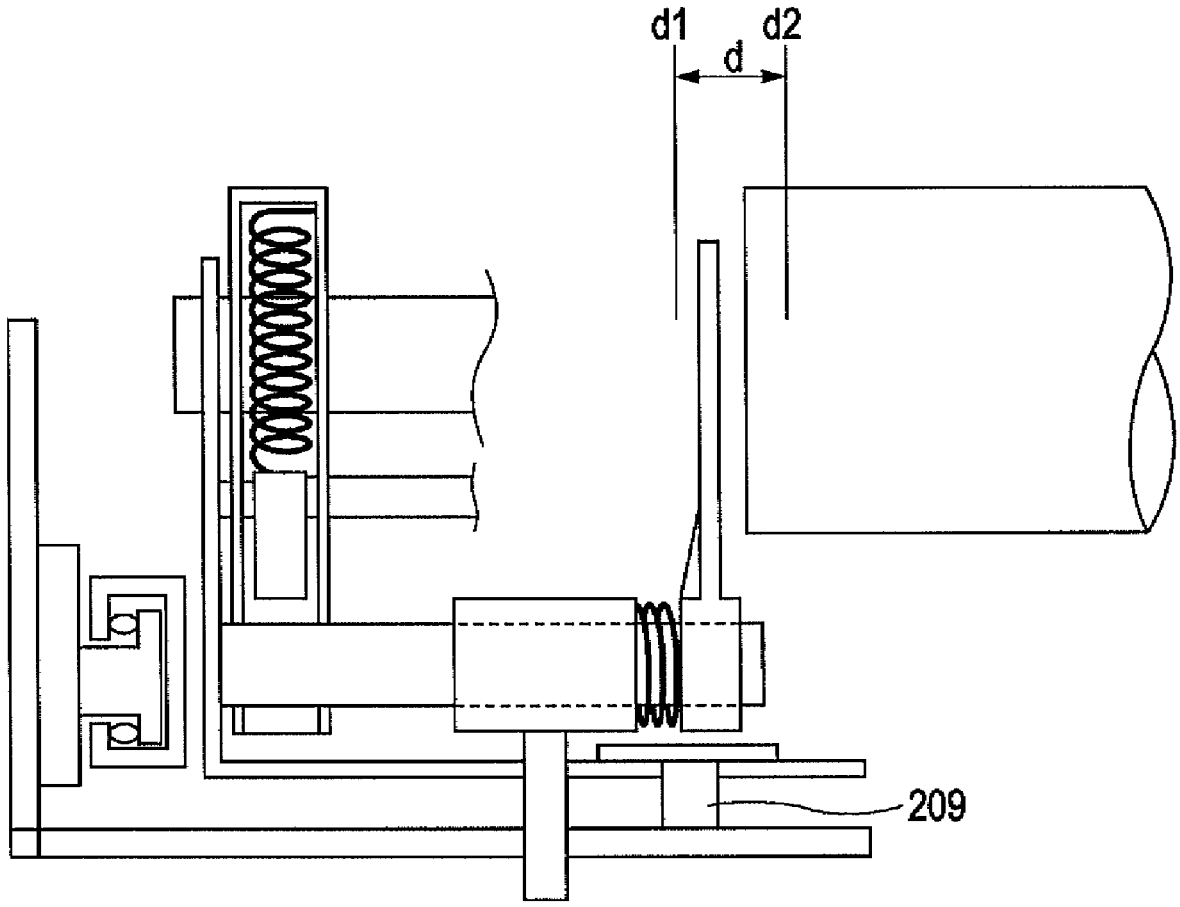
FIG. 16 is a schematic cross-sectional view showing one side of the fixing device according to the third embodiment.
Figure 21:
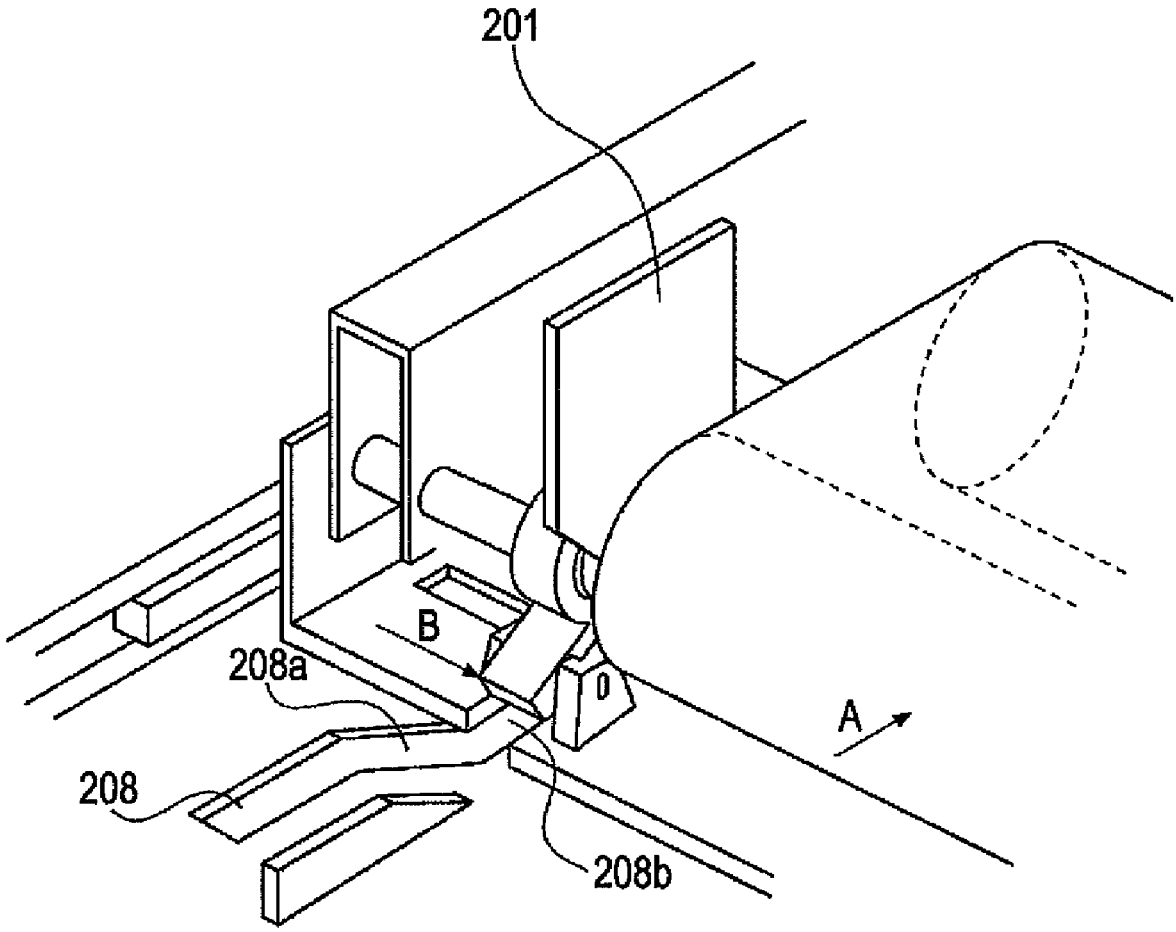
FIG. 21 is a schematic perspective view showing one side of the fixing device according to the third embodiment.

FIGS. 12, 13, and 15 illustrate a state where the fixing device 500 is accommodated within the main body of the image forming apparatus 100. FIGS. 14, 16, and 21 illustrate a state where the fixing device 500 is ejected from the main body of the image forming apparatus 100.

Referring to FIGS. 12, 13, and 15 illustrating the state where the fixing device 500 is accommodated within the main apparatus body, the belt-position restricting plate 201 and a collar 211 are attached to the shaft 204 in an axially movable fashion, and are connected to each other with a spring 214. When the collar 211 moves in the axial direction (direction B in FIG. 12), the belt-position restricting plate 201 is configured to move in the same direction.

As shown in FIG. 15, the collar 211 has a projection 211*a*. The projection 211*a* projects further downward relative to the bottom plate 203 of the fixing device 500 and extends through a guide slot 208 provided in a supporting plate 207 serving as part of the main body of the image forming apparatus 100.

The guide slot 208 has a bent section 208*a*. When the fixing device 500 moves in direction A shown in FIG. 12, the projection 211*a* moves along the bent section 208*a*, causing the collar 211 and the belt-position restricting plate 201 to move in direction B' which is opposite to direction B. In other words, as the state shown in FIGS. 13 and 15 (i.e. the state where the fixing device 500 is set inside the apparatus 100) is switched to the state shown in FIGS. 14 and 16 (i.e. the state where the fixing device 500 is ejected from the apparatus 100), the collar 211 and the belt-position restricting plate 201 are moved in direction B'.

A locking mechanism for the belt-position restricting plate 201 is provided below the belt-position restricting plate 201. This locking mechanism is constituted by a stationary plate 205 that is rotatable about a fulcrum 205*a* and by a bias spring 206 (FIGS. 13 and 14). Referring to FIGS. 14 and 13, when the fixing device 500 is being inserted into the main apparatus body, the stationary plate 205 is rotated by a projection 209 provided on the supporting plate 207 of the apparatus 100. This causes the stationary plate 205 to be separated from the belt-position restricting plate 201. As a result, the belt-position restricting plate 201 becomes freely movable in direction B (FIG. 12).

Figure 18:
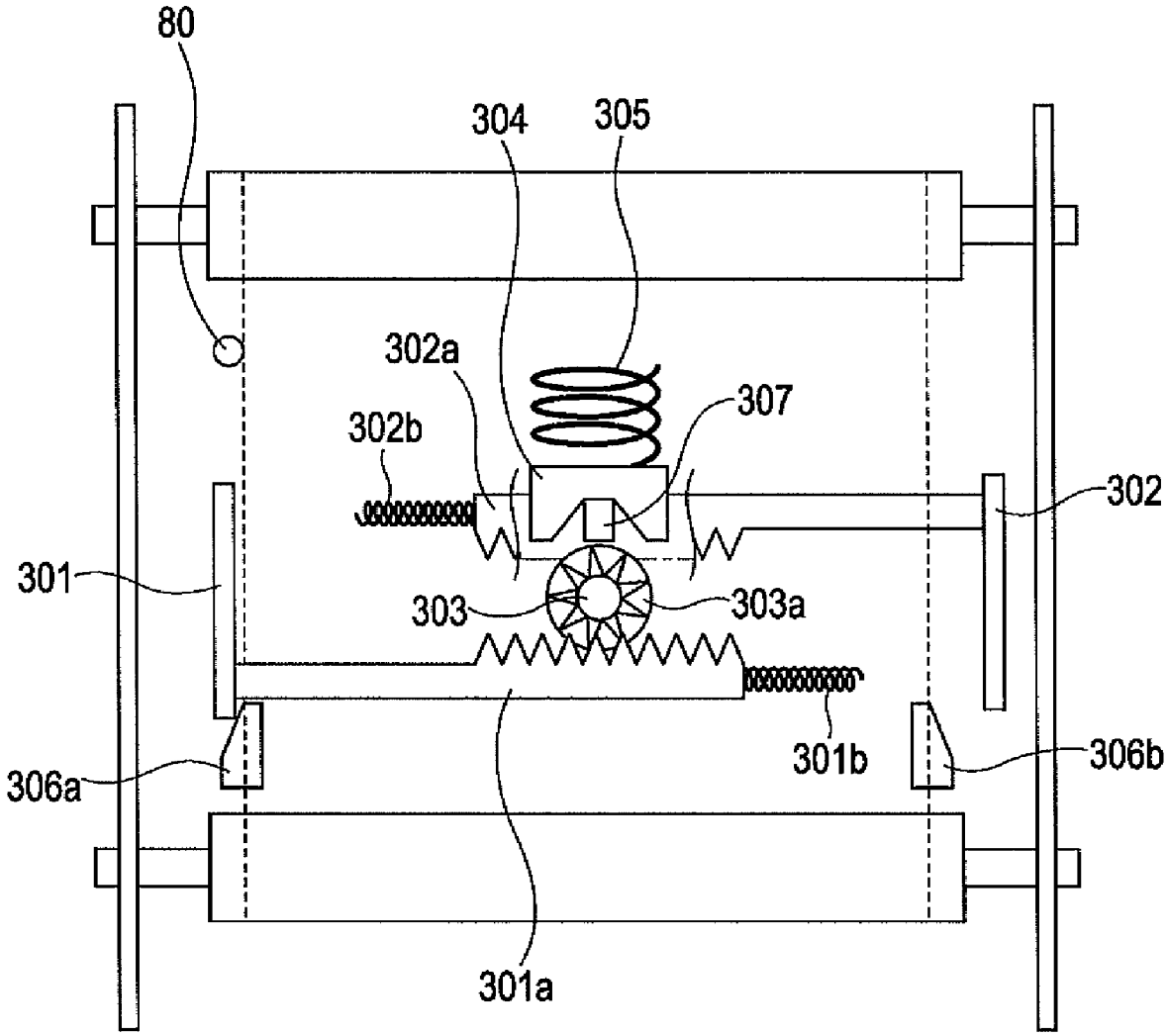
FIG. 18 is a schematic cross-sectional view of a belt-movement restricting mechanism according to a fourth embodiment of the present invention.

FIG. 15 illustrates the fixing device 500 accommodated within the main apparatus body and shows a state where a fixing process is performable. In this state, the collar 211 is located at a position corresponding to the bent section 208*a*, which is distant from the pressure belt 16, and the belt-position restricting plate 201 is stopped at a position spaced apart from the edge of the pressure belt 16. Specifically, the belt-position restricting plate 201 is positioned outside of a belt-position detection range d (between d1 and d2) of the position detecting mechanism 80 (FIG. 18).

Although the position of the pressure belt 16 in its width direction changes in accordance with the belt-misalignment correction control described earlier, the belt position is detected by the position detecting mechanism 80 and controlled within the belt-position detection range d in a meandering manner.

If by any possibility the edge of the pressure belt 16 protrudes from the belt-position detection range d, it is determined that the fixing device 500 is in an abnormal condition. In that case, the controller 600 discontinues the operation of the fixing device 500. In this embodiment, the belt-position control is implemented in a state where the range d is set at a distance of 4 mm in order to sufficiently protect the edges of the pressure belt 16 from damages.

How the fixing device 500 can be ejected from the main apparatus body is described next. FIG. 16 shows a state where the fixing device 500 is in the process of being ejected from the main apparatus body. Specifically, the projection 211*a* of the collar 211 is moved rightward in FIG. 12 along the guide slot 208 to a position 208*b*. This causes the belt-position restricting plate 201 to enter the belt-position detection range d. Depending on the position of the edge of the pressure belt 16, the belt-position restricting plate 201 may come into contact with the edge.

The dimensions of the spring 214 are determined geometrically such that even when the edge of the pressure belt 16 is at limit position d1 of the belt-position detection range d, the spring 214 still maintains its elasticity without becoming tightly closed.

Figure 17:
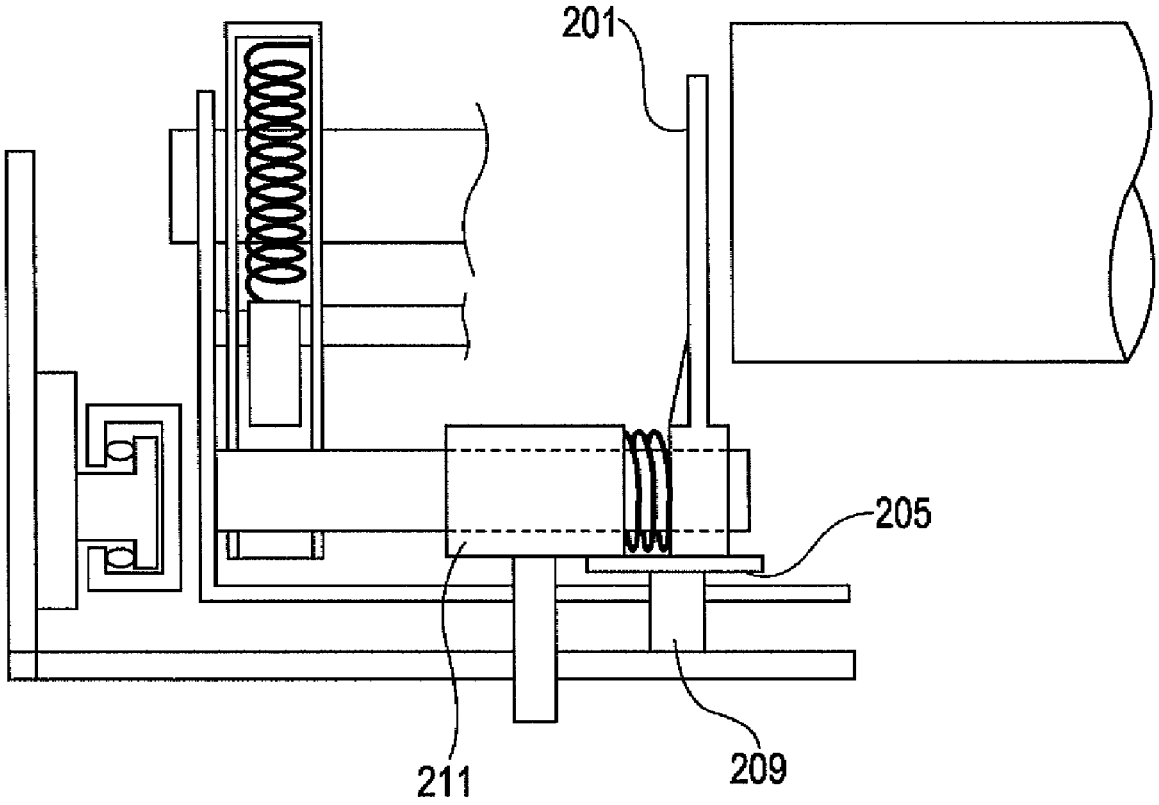
FIG. 17 is a schematic cross-sectional view showing one side of the fixing device according to the third embodiment.

FIGS. 17 and 21 show a state where the fixing device 500 has been further ejected from the main apparatus body.

The collar 211 and the belt-position restricting plate 201 are secured in position by the rotated stationary plate 205 and are maintained at their positions even after they are disengaged from the guide slot 208 and completely ejected from the main apparatus body.

Accordingly, in the state where the fixing device 500 is ejected from the main apparatus body for a jam clearing process, the position of the pressure belt 16 in its width direction can be restricted by the belt-position restricting plate 201.

Even if the pressure belt 16 does receive a force in the width direction in the course of a jam clearing process, the belt-position restricting plate 201 can prevent the pressure belt 16 from deviating from the belt-position detection range (preset range) d. Consequently, the jam recovery operation can be performed properly, thereby allowing the discontinued image forming process to resume quickly. When the fixing device 500 is inserted back into the main apparatus body, the positional restriction by the belt-position restricting plate 201 is released, so that the pressure belt 16 and the belt-position restricting plate 201 do not slide against each other during the normal fixing process. The edge of the pressure belt 16 is thereby prevented from becoming deteriorated by the belt-position restricting plate 201.

Although the belt-position restricting plate 201 is provided adjacent to only one of the edges of the pressure belt 16 in the width direction in this embodiment, two belt-position restricting plates adjacent to the opposite edges of the pressure belt 16 may alternatively be used.

The direction in which the fixing device 500 is ejected from the main apparatus body does not necessarily have to be a direction oriented towards a side surface of the main apparatus body, and may alternatively be a direction oriented towards the front surface of the main apparatus body. The direction of operation of the belt-position restricting plate or plates 201 may be set in accordance with the direction of ejection of the fixing device 500.

Fourth Embodiment

A fourth embodiment is described next with reference to FIGS. 18 and 19. A fixing device 500 serving as an image heating device according to the fourth embodiment is equipped with a heating roller and a pressure belt as in the third embodiment. The components included in this embodiment that have the same functions as, or alternatively similar functions to, those in the above embodiments are given the same reference numerals.

The fourth embodiment differs from the third embodiment in terms of the belt-movement restricting mechanism, particularly, the mechanism for moving belt-position restricting plates.

In this embodiment, belt-position restricting plates 301 and 302 are positioned adjacent to the opposite edges of the pressure belt 16 in the width direction. The belt-position restricting plates 301 and 302 respectively have racks 301*a* and 302*a* and are movable in a direction parallel to the width direction of the pressure belt 16.

The racks 301*a* and 302*a* are involute teeth of a module and share a pinion 303 of the module, the pinion 303 being positioned substantially in the center of the fixing device 500 as viewed in the belt-width direction. When the pinion 303 is rotated in one direction, the racks 301*a* and 302*a* cause the two belt-position restricting plates 301 and 302 to move in opposite directions from each other.

The racks 301*a* and 302*a* are respectively provided with springs 301*b* and 302*b*. The springs 301*b* and 302*b* pull the respective belt-position restricting plates 301 and 302 inward toward the pressure belt 16.

Referring to FIG. 18, when the fixing device 500 is accommodated within the main apparatus body, one of guides 306*a* and 306*b* provided in the main apparatus body is in contact with the corresponding one of the belt-position restricting plates 301 and 302 so as to hold that belt-position restricting plate at a predetermined position. As in the third embodiment, the belt-position restricting plates 301 and 302 are each held outside the belt-position detection range d. In this manner, the belt-position restricting plates 301 and 302 in the state shown in FIG. 18 are held at positions where they are not contactable with the pressure belt 16, whereby the edges of the pressure belt 16 can be protected from damages.

On the other hand, in the event of a jam, the fixing device 500 is ejected from the main apparatus body for a jam clearing process. In this case, the belt-position restricting plates 301 and 302 are positioned away from the guides 306*a* and 306*b* provided in the main apparatus body. As a result, the pulling forces of the springs 301*b* and 302*b* cause the belt-position restricting plates 301 and 302 to move inward toward each other so as to sandwich the pressure belt 16 therebetween.

Figure 19:
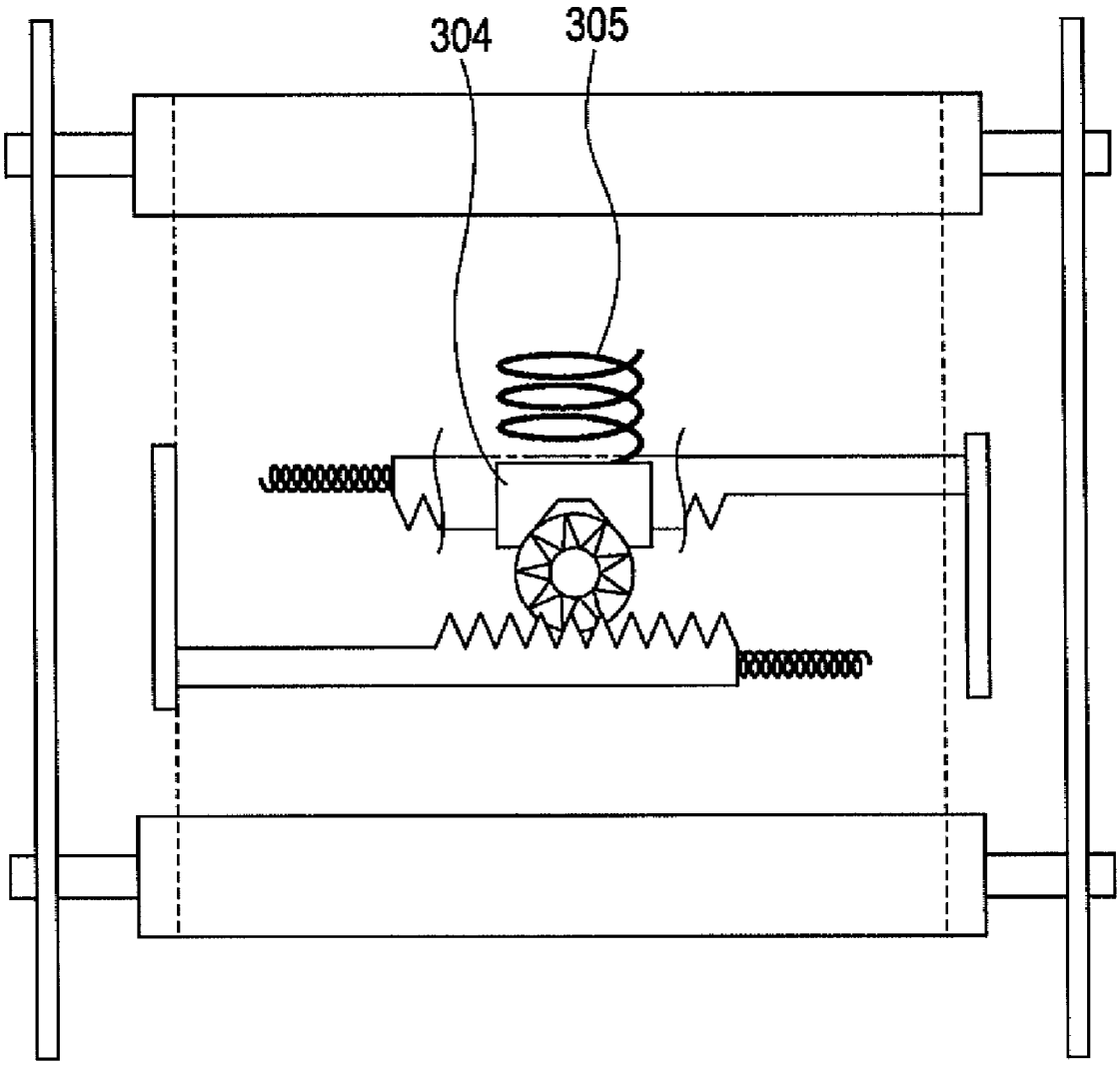
FIG. 19 is a schematic cross-sectional view of the belt-movement restricting mechanism according to the fourth embodiment.

As the fixing device 500 is further ejected from the main apparatus body, a brake 304 previously fixed in position by a projection 307 of the main apparatus body disengages itself from the projection 307 as shown in FIG. 19. Then, the brake 304 comes into contact with a rubber plate 303*a* provided integrally below the pinion 303. As a result, the brake 304 frictionally holds the rubber plate 303*a* with a biasing force of a spring 305, thereby preventing the pinion 303 from rotating.

In this case, although it is not certain where the pressure belt 16 is positioned in its width direction due to the misalignment correction control performed prior to the occurrence of the jam, the edges of the pressure belt 16 are always positioned within the belt-position detection range d of the position detecting mechanism 80.

In this embodiment, the belt-position restricting plates 301 and 302 are both configured to be movable in conjunction with the operation for ejecting the fixing device 500 from the main apparatus body, such that at least one of the belt-position restricting plates 301 and 302 is contactable with the corresponding edge of the pressure belt 16 (the state shown in FIG. 19).

Accordingly, when the fixing device 500 is ejected from the main apparatus body, the movement of the pressure belt 16 in its width direction can be advantageously restricted, thereby preventing the pressure belt 16 from deviating from the belt-position detection range d during the jam clearing process.

Although the belt-position restricting plates in the third and fourth embodiments are configured to be moved by utilizing the ejecting operation of the fixing device 500 from the main apparatus body, alternative configurations are also permissible. For example, an actuator such as a motor or a solenoid may be provided which is configured to move the belt-position restricting plates within a time period starting from the time a jam has occurred to the time a jam clearing process is allowed to be performed. With this configuration, the belt-position restricting plates are movable even in the state where the fixing device 500 is set within the main apparatus body. In this case, the belt-position restricting plates may be withdrawn from the belt-position detection range using the actuator within a time period starting from the time the jam clearing process has been completed to the time the pressure belt 16 begins to rotate for starting the jam recovery operation.

Although a fixing device has been described as an example of an image heating device in the first to fourth embodiments, the present invention can alternatively be applied in other manners. For example, the present invention can be applied to a gloss enhancing device that heats a sheet having a toner image fixed thereon by a fixing device to enhance the glossiness of the image.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2007-162489 filed Jun. 20, 2007, which is hereby incorporated by reference herein in its entirety.

What is claimed is:

1. An image heating device comprising:

an endless belt that allows a toner image on a recording material to be heated at a nip portion;

a rotary member configured to form the nip portion together with the endless belt;

a contact/separation unit configured to perform at least one of a contact operation to bring the endless belt and the rotary member into contact with each other and a separation operation to bring the endless belt and the rotary member out of contact with each other; and a restricting unit configured to relatively move to a position where the restricting unit comes into pressure contact with an outer surface of the endless belt so as to restrict a movement of the endless belt in a width direction thereof when the recording material is removed from the endless belt in a separated state from the rotary member.

2. The image heating device according to claim 1, further comprising a supporting member that rotatably supports the endless belt, wherein the restricting unit includes a rotary member that is pressure contactable with the endless belt such that the rotary member and the supporting member are capable of holding the endless belt therebetween.

3. The image heating device according to claim 1, wherein the restricting unit is configured to move into contact with the endless belt in conjunction with the separation operation performed by the contact/separation unit.

4. The image heating device according to claim 1, wherein the restricting unit is configured to move out of contact with the endless belt in conjunction with the contact operation performed by the contact/separation unit.

5. An image heating device comprising:

an endless belt that allows a toner image on a recording material to be heated at a nip portion;

a rotary member configured to form the nip portion together with the endless belt;

a supporting member that rotatably supports the endless belt;

a control unit configured to perform control so as to correct misalignment of the endless belt in a width direction thereof in the course of rotation of the endless belt, the control performed by displacing at least one longitudinal end of the supporting member; and a restricting unit disposed outside the endless belt in the width direction, wherein in a state where the endless belt is stopped from rotating, the restricting unit is configured to relatively move to a contact position where the restricting unit is contactable with an edge of the endless belt in the width direction so as to restrict a movement of the endless belt in the width direction when the recording material is removed from the endless belt.

6. The image heating device according to claim 5, further comprising a contact/separation unit configured to perform a contact or separation operation to bring the endless belt and the rotary member into or out of contact with each other, wherein the restricting unit is configured to move to the contact position in conjunction with the separation operation performed by the contact/separation unit, the contact position being where the restricting unit is contactable with the edge of the endless belt in the width direction.

7. The image heating device according to claim 6, wherein the restricting unit is configured to move from the contact position to a withdrawn position in conjunction with the contact operation performed by the contact/separation unit, the contact position being where the restricting unit is contactable with the edge of the endless belt in the width direction and the withdrawn position being where the restricting unit is withdrawn from the contact position.

8. The image heating device according to claim 5, further comprising an ejection unit configured to be ejectable from a main body of an apparatus while holding the endless belt, wherein the restricting unit is configured to move to the contact position in conjunction with an operation for ejecting the ejection unit from the main body of the apparatus, the contact position being where the restricting unit is contactable with the edge of the endless belt in the width direction.

9. The image heating device according to claim 8, wherein the restricting unit is configured to move to a withdrawn position in conjunction with an operation for setting the ejection unit inside the main body of the apparatus, the withdrawn position being where the restricting unit is withdrawn from the contact position.

* * * * *